US008118631B2

(12) United States Patent
Ochiai

(10) Patent No.: US 8,118,631 B2
(45) Date of Patent: Feb. 21, 2012

(54) OUTBOARD MOTOR

(75) Inventor: Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/956,123

(22) Filed: Nov. 30, 2010

(65) Prior Publication Data

US 2011/0070786 A1 Mar. 24, 2011

Related U.S. Application Data

(63) Continuation of application No. 12/391,329, filed on Feb. 24, 2009, now Pat. No. 7,867,048.

(30) Foreign Application Priority Data

Feb. 25, 2008 (JP) ..... 2008-042374

(51) Int. Cl.
*F01N 3/04* (2006.01)

(52) U.S. Cl. ..... 440/89 H; 440/77; 440/89 R

(58) Field of Classification Search ..... 440/77, 440/89 D, 89 F, 89 G, 89 H, 89 J, 89 R; 60/299, 60/317, 323, 324
See application file for complete search history.

(56) References Cited

U.S. PATENT DOCUMENTS 5,554,057 A 9/1996 Abe et al.
5,556,311 A * 9/1996 Fujimoto ..... 440/89 R
6,368,726 B1 * 4/2002 Holpp et al. ..... 428/593
6,884,133 B2 * 4/2005 Ishii ..... 440/89 H
7,252,568 B2 * 8/2007 Ito et al. ..... 440/77
7,698,889 B1 * 4/2010 Burk et al. ..... 60/323

OTHER PUBLICATIONS

Ochiai; "Outboard Motor"; U.S. Appl. No. 12/391,329, filed Feb. 24, 2009.

Ochiai; "Outboard Motor"; U.S. Appl. No. 12/956,120, filed Nov. 30, 2010.

* cited by examiner

*Primary Examiner* — Lars A Olson
(74) *Attorney, Agent, or Firm* — Keating & Bennett, LLP

(57) ABSTRACT

An outboard motor includes an engine, and a top cowling and a bottom cowling that are arranged to cover the engine. A flow-joining pipe is connected to each exhaust port of a plurality of cylinders of the engine. A first exhaust pipe, a second exhaust pipe, and a third exhaust pipe are connected to the flow-joining pipe in sequence. The flow-joining pipe and the first exhaust pipe are connected generally at the same height as a bottommost of the cylinders of the engine. The third exhaust pipe is disposed above a topmost of the cylinders of the engine. A catalyst is disposed in a connecting portion between the first exhaust pipe and the second exhaust pipe so as to be housed in an upper end portion of the first exhaust pipe and in a lower end portion of the second exhaust pipe. The outboard motor is thus able to prevent water from adhering to a catalyst while avoiding any increase in size.

13 Claims, 17 Drawing Sheets

OUTBOARD MOTOR

BACKGROUND OF THE INVENTION

1. Field of the Invention

The present invention relates to an outboard motor to be mounted in a boat.

2. Description of the Related Art

In general, an outboard motor mounted in a boat has an upper casing and a lower casing, and an engine is disposed in the upper casing. An exhaust passage connected to a plurality of cylinders in the engine is disposed to extend from the inside of the upper casing to a bottom portion of the lower casing. The exhaust passage is provided with a catalyst that purifies exhaust gas.

In such a construction, exhaust gas flowing out from each cylinder to the exhaust passage is purified in the catalyst, and then discharged into water from the bottom portion of the lower casing.

A lower end portion of the exhaust passage is immersed in water. Therefore, water in the lower end portion of the exhaust passage may flow backward to an engine side as a result of negative pressure or the like that is generated in the engine. Especially, a four-stroke engine is largely affected by exhaust pulsation, so water is sucked into an engine side by strong force in the exhaust passage.

In order to prevent deterioration of the catalyst, water flowing backward in the exhaust passage must be prevented from adhering to the catalyst. To prevent water adhesion to the catalyst, an outboard motor in which a catalyst is disposed in an upper casing has been developed (for example, refer to JP-A-2000-356123).

However, even if a catalyst is simply disposed in the upper casing as indicated in JP-A-2000-356123, water adhesion to the catalyst cannot be sufficiently prevented when water flows backward in the exhaust passage. In addition, with the construction of the outboard motor described in JP-A-2000-356123, the catalyst must be disposed at an even higher position to securely prevent water adhesion to the catalyst. Accordingly, the size of the outboard motor is disadvantageously increased.

SUMMARY OF THE INVENTION

In order to overcome the problems described above, preferred embodiments of the present invention provide an outboard motor that can sufficiently prevent water adhesion to a catalyst while avoiding any increase in size.

An outboard motor according to a preferred embodiment of the present invention preferably includes a cowling, an engine body having a plurality of cylinders disposed to be lined vertically in the cowling, a discharge section that is disposed below the cowling and discharges burned gas generated in the plurality of cylinders, a discharge passage that guides burned gas from the plurality cylinders to the discharge section, and a catalyst that purifies the burned gas in the exhaust passage. The exhaust passage includes a plurality of first passages connected to the plurality of cylinders, and disposed to be joined at a flow-joining portion located below the topmost cylinder, a second passage connected to the flow-joining portion and extending above the flow-joining portion, and a third passage that passes above the topmost cylinder from an upper end of the second passage and is connected to the discharge section. The catalyst is disposed in the second passage.

In this outboard motor, the engine body is disposed in the cowling. The discharge section, which discharges burned gas in a plurality of cylinders of the engine body to the outside, is disposed in a lower portion of the cowling. Burned gas discharged from a plurality of cylinders of the engine body is guided to the discharge section through the exhaust passage.

The exhaust passage includes the first passage, the second passage, and the third passage. Burned gas discharged from each cylinder is guided to the discharge section while sequentially passing through the first to third passages. The catalyst, which purifies burned gas, is disposed in the second passage.

In this outboard motor, the third passage is arranged to pass above the topmost cylinder. That is, a portion of the third passage is disposed at a sufficiently high position in the cowling.

In this case, when water intrudes from the discharge section into the third passage, the water can be prevented from passing the third passage and intruding into the second passage. Accordingly, water adhesion to the catalyst can be prevented. As a result, lowering of catalyst purification performance can be prevented.

The second passage is disposed to be connected to a joining portion of the first passage and to extend higher than the flow-joining portion. The flow-joining portion is located lower than the topmost cylinder. In this case, the catalyst can be disposed lower than the topmost cylinder by disposing the catalyst in the second passage. Accordingly, the catalyst can be disposed in the outboard motor while a vertical height of the outboard motor is prevented from being increased.

As a result, water adhesion to the catalyst can be sufficiently prevented while the outboard motor avoids any increase in size.

The second passage preferably has a first straight passage disposed to extend vertically on the side of a plurality of cylinders. The catalyst may be disposed in the first straight passage.

In this case, an increase in the width of the outboard motor can be prevented by disposing the catalyst in the first straight passage.

The third passage may preferably have a second straight passage disposed on the opposite side of the plurality of cylinders from the first straight passage, and a connection passage that is disposed above the topmost cylinder and that connects the second passage and the second straight passage.

In this case, the second straight passage is disposed on the opposite side of the plurality of cylinders from the first straight passage. Thus, the plurality of cylinders can be disposed in the center or approximate center of the cowling. Accordingly, stability of the outboard motor can be improved.

The connection passage is disposed above the topmost cylinder. Thus, water can be securely prevented from flowing into the second passage from the second straight passage. Accordingly, water adhesion to the catalyst can be securely prevented.

A plurality of cylinders and the second straight passage preferably may be provided in a common cylinder block.

In this case, the exhaust passage can be integral with the cylinder block. Thus, structure around the engine body can be simplified.

The outboard motor may further include a first oxygen sensor disposed at an upstream side of the catalyst in the exhaust passage.

In this case, water adhesion to the first oxygen sensor can be securely prevented. Accordingly, the first oxygen sensor can be improved in reliability. As a result, an air-fuel ratio of burned gas can be detected in high precision based on a detected value of the first oxygen sensor.

The outboard motor may further include a second oxygen sensor disposed at a downstream side of the catalyst in the second passage.

In this case, the second passage is disposed upstream of the third passage. Thus, water adhesion to the second oxygen sensor can be securely prevented. Accordingly, the second oxygen sensor can be improved in reliability. As a result, an air-fuel ratio of burned gas, which has been purified through the catalyst, can be detected with high precision based on a detected value of the second oxygen sensor. Accordingly, a purification rate of burned gas by the catalyst can be detected in high precision.

The outboard motor preferably may further include a moisture capture member disposed in the third passage above the topmost cylinder.

In this case, when droplets are created by the water intruded from the discharge section into the discharge passage, the droplets can be captured by the moisture capture member. Accordingly, droplet adhesion to the catalyst can be prevented.

In the exhaust passage, when a sensor such as an oxygen sensor is disposed at an upstream side of the moisture capture member, droplet adhesion to the sensor can be prevented. Accordingly, the sensor can be sufficiently improved in reliability.

The outboard motor may preferably further include a first temperature sensor disposed in a downstream side of the catalyst in the second passage.

In this case, the second passage is disposed upstream of the third passage. Thus, water adhesion to the first temperature sensor can be securely prevented. Accordingly, the first temperature sensor can be improved in reliability. As a result, a purification state of burned gas in the catalyst can be detected with high precision based on a detected value of the first temperature sensor. Accordingly, a determination can be easily made whether the catalyst is functioning normally or not.

The outboard motor preferably may further include a second temperature sensor disposed in the third passage further below than the topmost cylinder.

In this case, water intrusion into the exhaust passage can be detected by the second temperature sensor.

The outboard motor may further include a controller arranged to perform water intrusion suppression control to suppress water intrusion from the discharge section into the discharge passage based on a detected value of the second temperature sensor.

In this case, water intrusion suppression control can be performed quickly based on the detected value of the second temperature sensor. Accordingly, water is securely prevented from flowing backward in the exhaust passage.

The outboard motor preferably may further include a cooling water passage disposed to cover the exhaust passage, and an air vent disposed generally at the highest portion of the cooling water passage.

In this case, the exhaust passage can be cooled by cooling water in the cooling water passage. Thus, temperature increases in the catalyst can be prevented. Accordingly, temperature increases in the cowling and components of the engine body can be prevented.

In this outboard motor, the air vent preferably is disposed generally at the highest portion of the cooling water passage. In this case, air collected in an upper portion of the cooling water passage can be efficiently discharged. Thus, cooling water can be efficiently supplied to the entire cooling water passage. As a result, the exhaust passage can be efficiently cooled.

The outboard motor may further include an intake passage that guides air to a plurality of cylinders, and the intake passage may be disposed to pass between the third passage and the cowling. In this case, the intake passage can be provided without any increase in size of the cowling.

The outboard motor preferably may further include a timing belt disposed above the engine body, and a belt tensioner that is disposed above the engine body and applies tension to the timing belt. The third passage may be disposed to pass above the belt tensioner.

In this case, expansion of the timing belt in the width direction can be sufficiently limited by the belt tensioner.

The third passage is preferably arranged to pass above the belt tensioner. Thus, the third passage can be arranged to pass above a position where the expansion of the timing belt in the width direction is sufficiently squeezed. In this case, when a portion of the third passage is disposed on the opposite side of a plurality of cylinders from the second passage, a portion of the third passage and the second passage can be prevented from being widely separated. Accordingly, an increase in the width of the outboard motor can be prevented.

The outboard motor preferably may further include a flywheel magneto cover disposed above the engine body and the timing belt, and the third passage may be disposed to pass between the timing belt and the flywheel magneto cover.

In this case, the third passage is cooled by an air current generated in the flywheel magneto cover. Accordingly, a temperature increase in the exhaust passage can be prevented. Thus, a temperature increase of the catalyst can be prevented.

The outboard motor preferably may further include the cooling water passage disposed to cover the exhaust passage, and a cooling water supply portion disposed in an area that covers a lower end portion of the first passage of the cooling water passage or a lower end portion of the second passage of the cooling water passage.

In this case, the exhaust passage can be cooled by the cooling water passage. The cooling water supply portion is disposed in an area of the cooling water passage that covers the lower end portion of the first passage or the lower end portion of the second passage. That is, the cooling water supply portion is disposed in a lower end portion of the cooling water passage. In this case, the cooling water supply portion is utilized as a discharge section of cooling water, so that cooling water in the cooling water passage can be efficiently discharged from the cooling water supply portion.

The lower end portion of the first or second passage preferably may be located below the bottommost cylinder.

In this case, when water is collected in the lower end portion of the first or second passage due to condensation or the like, the water flow to the downstream side by burned gas discharged from each cylinder can be prevented. Accordingly, water adhesion to the catalyst can be securely prevented.

According to various preferred embodiments of the present invention, when water intrudes from the discharge section into the third passage, the water can be prevented from passing the third passage and intruding into the second passage. Accordingly, water adhesion to the catalyst can be prevented. As a result, a decrease in the catalyst purification performance can be prevented.

The catalyst can be disposed lower than the topmost cylinder. Accordingly, the catalyst can be disposed in the outboard motor while an increase in a vertical height of the outboard motor is prevented.

As a result, water adhesion to the catalyst can be sufficiently prevented while preventing any increase in size of the outboard motor.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
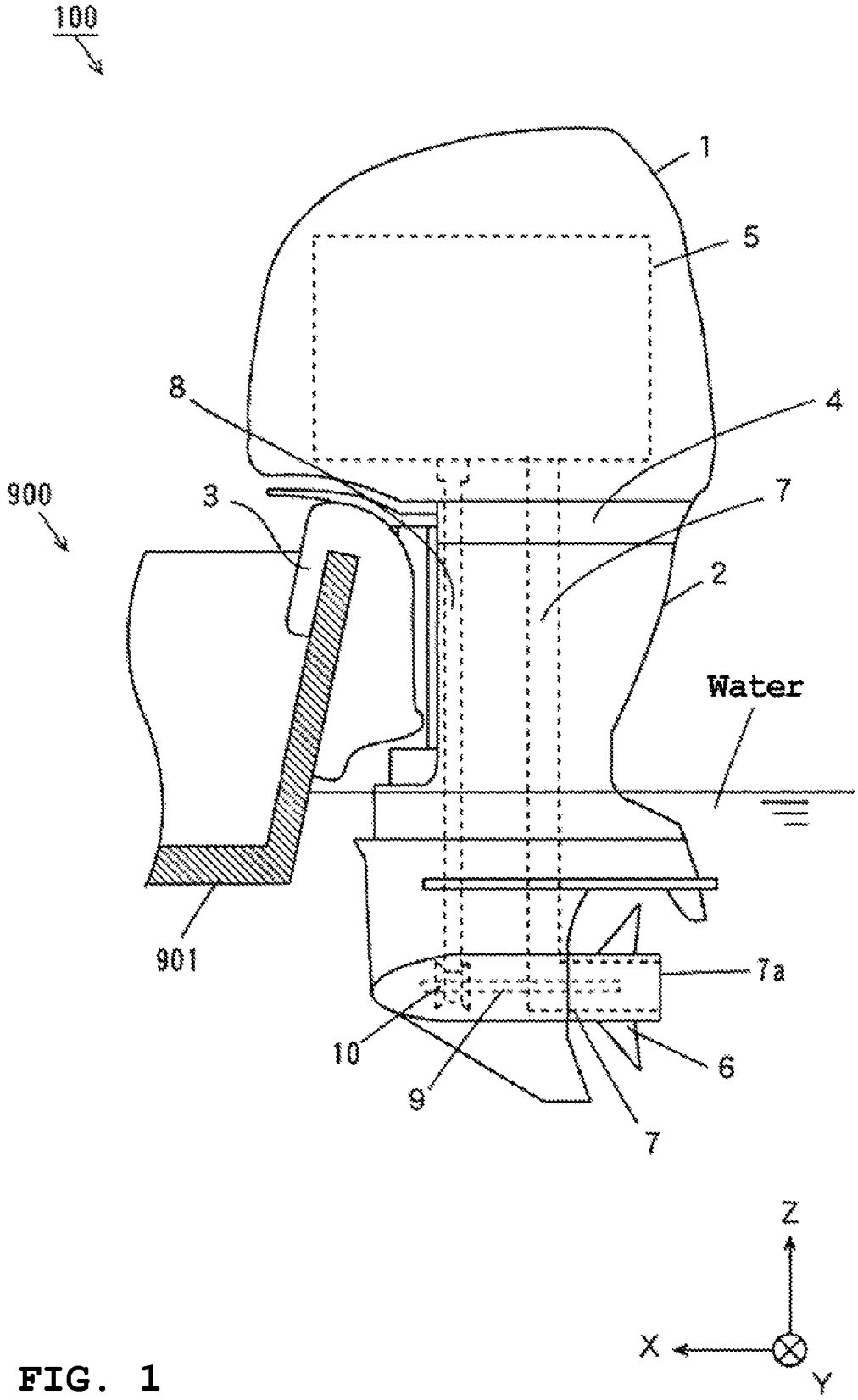
FIG. 1 is a side view showing an outboard motor according to a first preferred embodiment of the present invention.

Hereinafter, an outboard motor according to preferred embodiments of the present invention is described with reference to drawings.

In a preferred embodiment described below, a downstream end opening 7*a* is an example of discharge section; a flow-joining pipe 134, a first exhaust pipe 71, a second exhaust pipe 72, third exhaust pipe 73, an exhaust passage 70, and an exhaust passage 7 are examples of an exhaust passage; a flow-joining pipe 134 is an example of a first passage; a first exhaust pipe 71 and a second exhaust passage 72 are examples of second passage; a third exhaust pipe 73, an exhaust passage 70, and an exhaust passage 7 are examples of a third passage; a second exhaust pipe 72 is an example of a first straight passage; an exhaust passage 70 is an example of a second straight passage; a third exhaust pipe 73 is an example of a connection passage; a flow path 700 is an example of a cooling water passage; an extension pipe 731 is an example of an air vent; an intake pipe 56 is an example of an intake passage; and an ECU 103 is an example of a controller.

The above description merely provides non-limiting elements of preferred embodiments of the present invention. Other various elements that have the same or similar constitution or function as described herein may be used.

First Preferred Embodiment (1) General Construction of Outboard Motor

FIG. 1 is a side view showing an outboard motor according to a first preferred embodiment of the present invention.

As shown in FIG. 1, an outboard motor 100 according to a preferred embodiment of the present invention preferably includes an upper casing 1, a lower casing 2, a clamp bracket 3, and an exhaust guide 4. The upper casing 1, the lower casing 2, and the clamp bracket 3 are fixed to the exhaust guide 4.

The outboard motor 100 is mounted to a hull 901 of a boat 900 through the clamp bracket 3. In FIG. 1 and FIGS. 2 to 16 described below, as indicated by arrows X, Y, and Z, three directions that are perpendicular to one another are defined as X direction, Y direction, and Z direction. The direction that the X direction arrow points is the front, and its opposite is the rear. The direction that the Z direction arrow points is the top, and its opposite is the bottom. The direction that the respective arrows of X direction, Y direction, and Z direction point is a + side, and its opposite is a − side.

An engine 5 is disposed in the upper casing 1. The engine 5 is fixed to the exhaust guide 4. A propeller 6 is disposed in a lower portion of the lower casing 2. An exhaust passage 7 is disposed in the lower casing 2. The exhaust passage 7 is arranged to extend from the engine 5 through the exhaust guide 4 and the lower casing 2 to a rear end of the propeller 6. An upper end of the exhaust passage 7 is connected to the after-mentioned exhaust passage 70 (refer to FIG. 2 and FIG. 3) of the engine 5.

A drive shaft 8 is disposed in the lower casing 2 along a vertical direction. The drive shaft 8 is fixed to a crankshaft 142 (refer to FIG. 11) of the engine 5. A propeller shaft 9 is fixed to the inside of the propeller 6. The propeller shaft 9 is connected to a lower portion of the drive shaft 8 through a bevel gear 10.

According to the structure described above, the driving force generated by the engine 5 is transmitted through the drive shaft 8 and the propeller shaft 9 to the propeller 6. Thus, the propeller rotates in a normal direction or a reverse direction. As a result, a propulsive force to propel the boat 900 forward or backward is generated. Exhaust gas (burned gas) discharged from the engine 5 is discharged into the water from a downstream end opening 7*a* of the exhaust passage 7.

Hereinafter, the engine 5 and its surrounding structure are described in detail with reference to the drawings.

(2) Arrangement of Peripheral Devices of Engine

Hereinafter, an arrangement of peripheral devices of the engine 5 is described with reference to drawings.

Figure 2:
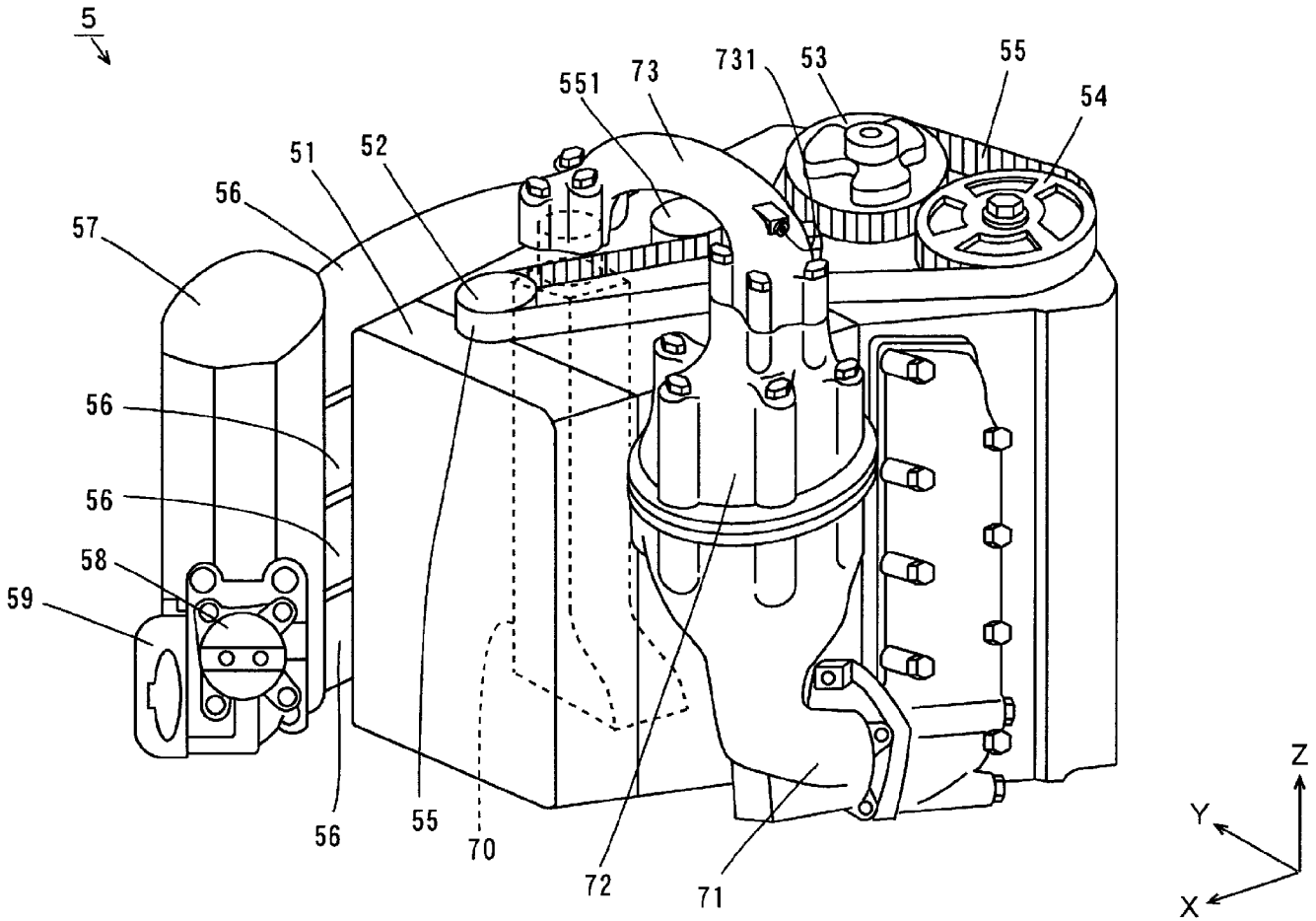
FIG. 2 is a schematic perspective view of an engine.
Figure 3:
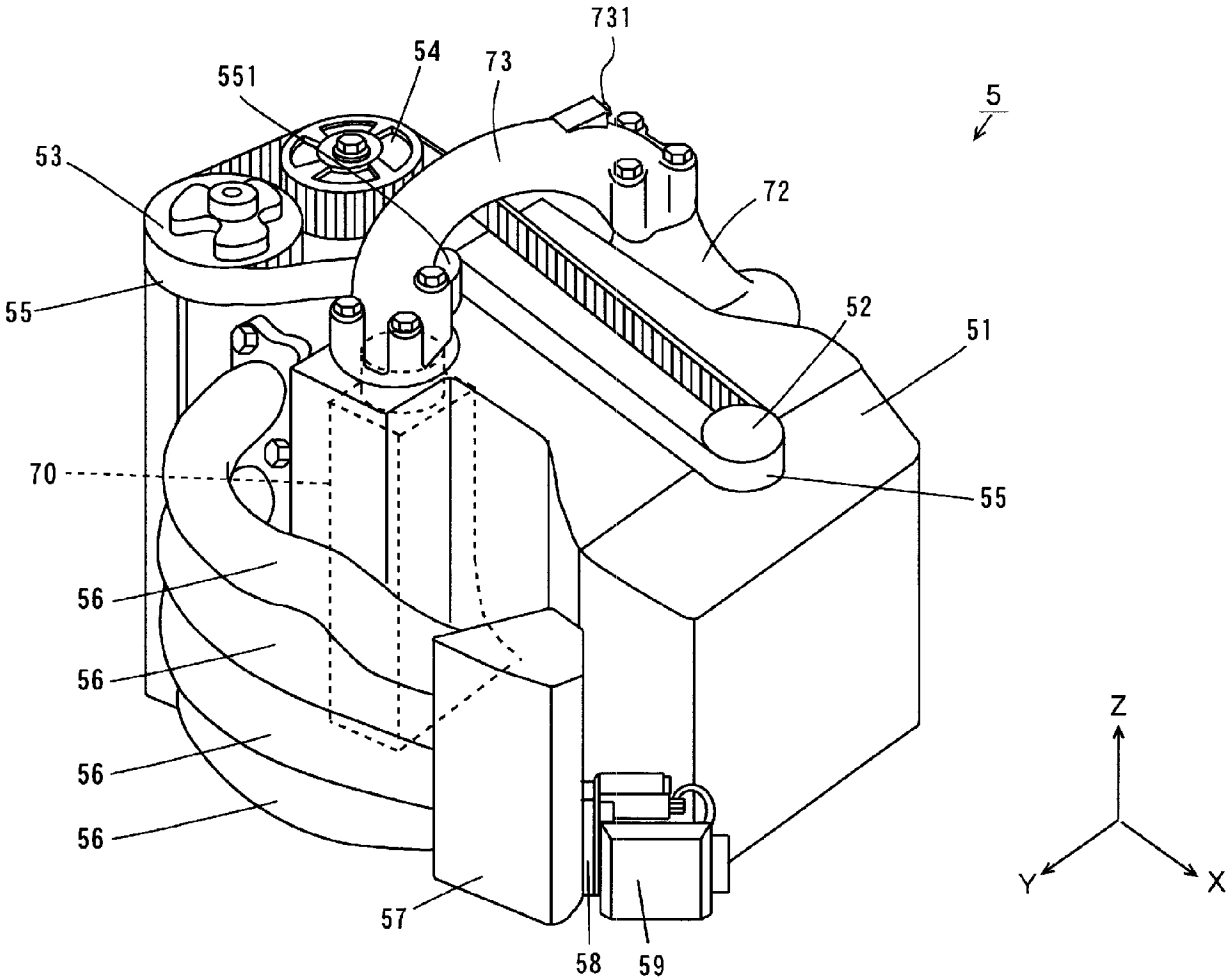
FIG. 3 is a schematic perspective view of the engine.

FIG. 2 and FIG. 3 are schematic perspective views showing the engine 5.

As shown in FIG. 2 and FIG. 3, the engine 5 has an engine body 51. In FIG. 2, the engine body 51 is shown in a simplified manner for easier description.

A drive pulley 52 is disposed above a front portion of the engine body 51. The drive pulley 52 is fixed to the crankshaft 142 (refer to FIG. 11). Driven pulleys 53, 54 are disposed above a rear portion of the engine body 51. The driven pulleys 53, 54 are fixed to a camshaft (not shown) of the engine 5. A timing belt 55 is wound around the drive pulley 52 and the driven pulleys 53, 54. In the present preferred embodiment, a belt tensioner 551 is disposed above a center portion of the engine body 51. The belt tensioner 551 maintains the tension of the timing belt 55.

The exhaust passage 70 is located on a +Y side of the engine body 51. One end of the first exhaust pipe 71 (FIG. 2) generally in the shape of L is connected to a side surface of the engine body 51 on a −Y side. One end of the second exhaust pipe 72 in the shape of a cylinder is connected to the other end of the first exhaust pipe 71. A catalyst 11, described in more detail below, is housed in the first exhaust pipe 71 and the second exhaust pipe 72 (refer to FIG. 5 and FIG. 9).

One end of the third exhaust pipe 73 in the shape of inverted U is connected to the other end of the second exhaust pipe 72. The other end of the third exhaust pipe 73 is connected to one end of the exhaust passage 70. The third exhaust pipe 73 is disposed to pass above the timing belt 55. The extension pipe 731 is disposed in the third exhaust pipe 73. The extension pipe 731 is described later.

In this way, the first and second exhaust pipes 71, 72 are disposed on one side of the engine body 51, and the exhaust passage 70 is disposed on the other side thereof. The third exhaust pipe 73 is arranged to pass above the engine body 51 to connect the second exhaust pipe 72 and the exhaust passage 70. Accordingly, when water flows backward in the exhaust passage 7 in FIG. 1, the water can be prevented from passing in the third exhaust pipe 73 toward an upstream side.

As described above, the catalyst 11 (refer to FIG. 5) is housed in the first exhaust pipe 71 and the second exhaust pipe 72. In other words, in the present preferred embodiment, the catalyst 11 is disposed upstream of the third exhaust pipe 73. Accordingly, when water flows backward in the exhaust passage 7 in FIG. 1, the catalyst 11 can be sufficiently protected against water adhesion.

First ends of a plurality of intake pipes 56 (for example, four pipes in the present preferred embodiment) are connected to a side surface of the engine body 51 on the +Y side. Second ends of the plurality of intake pipes 56 are connected to a surge tank 57 disposed on the +Y side of the engine body 51. A throttle body 58 and a throttle drive motor 59 are disposed on a lower portion of the surge tank 57.

Figure 4:
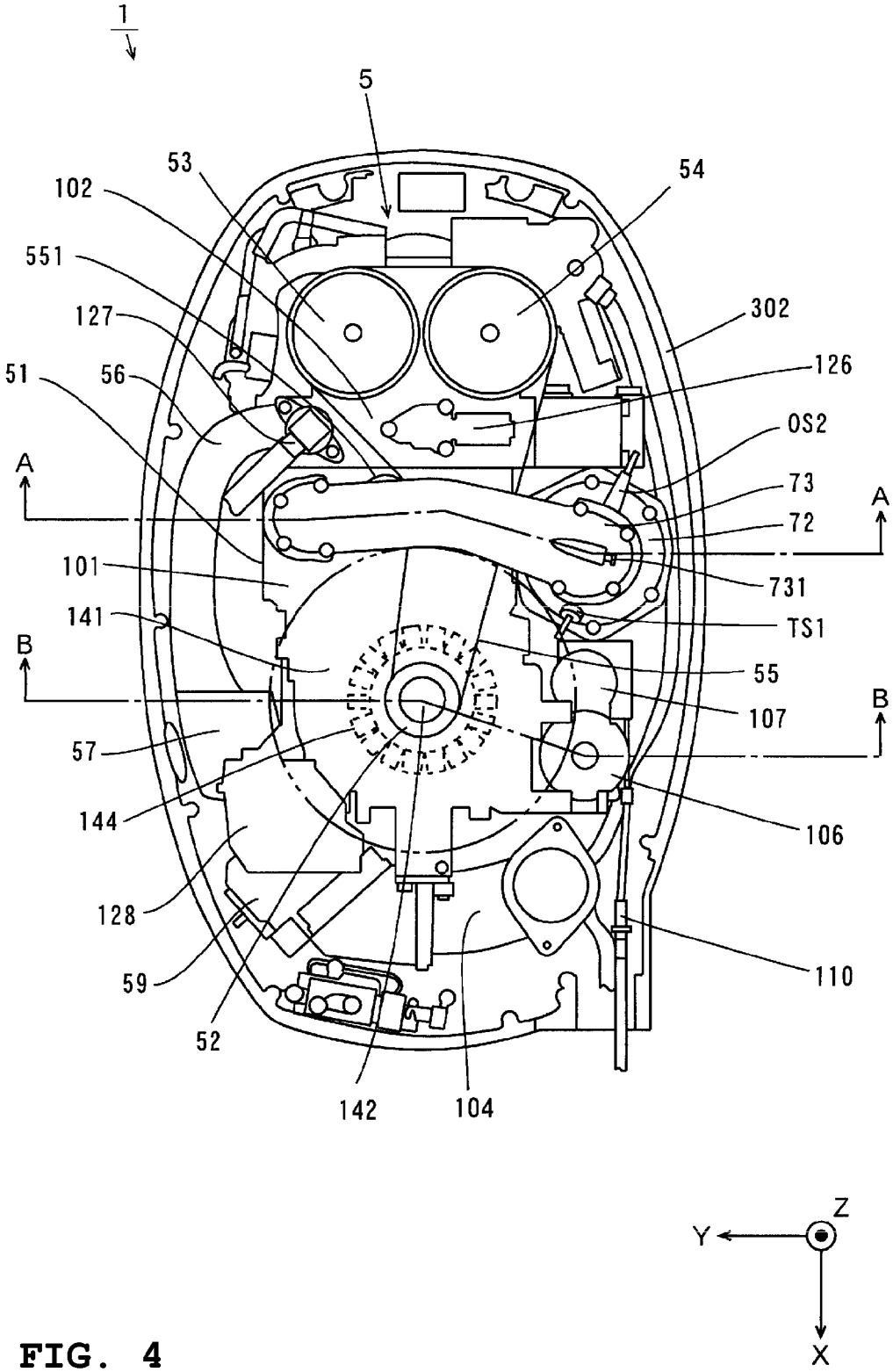
FIG. 4 is a top view showing a construction of the engine.
Figure 5:
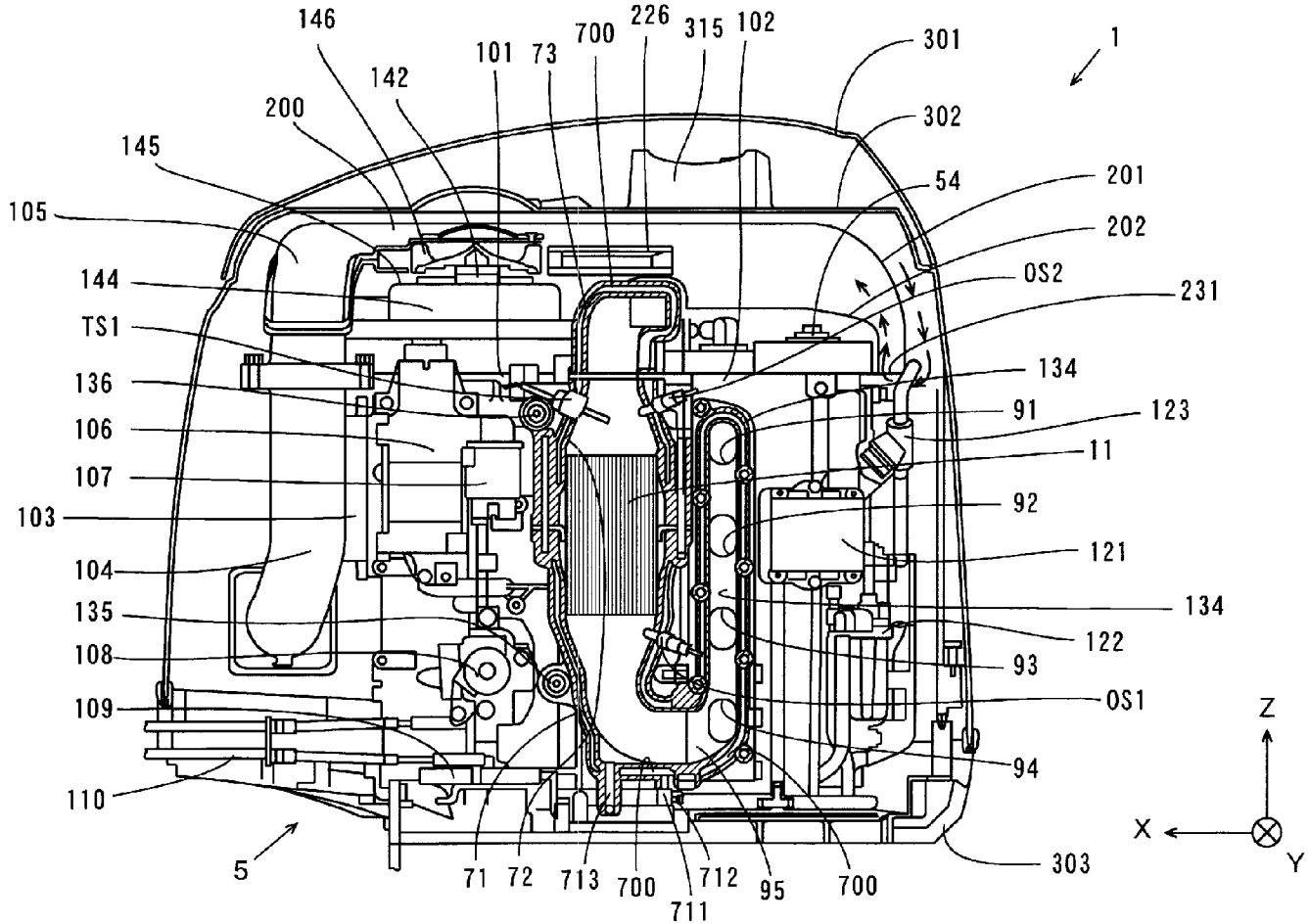
FIG. 5 is a partial cross-section of the inside of the upper casing as seen from a −Y side.
Figure 6:
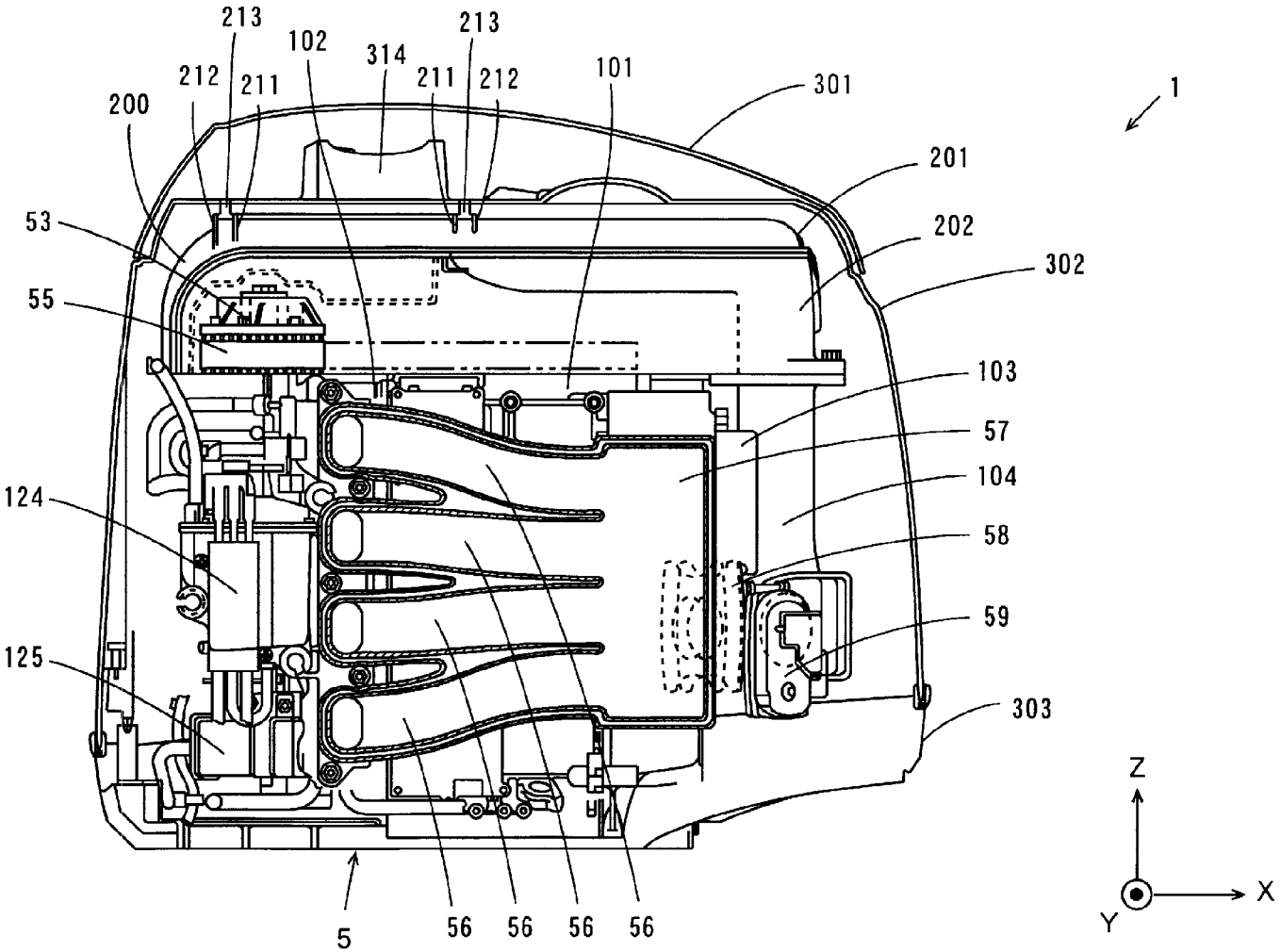
FIG. 6 is a partial cross-section of the upper casing as seen from a +Y side.
Figure 7:
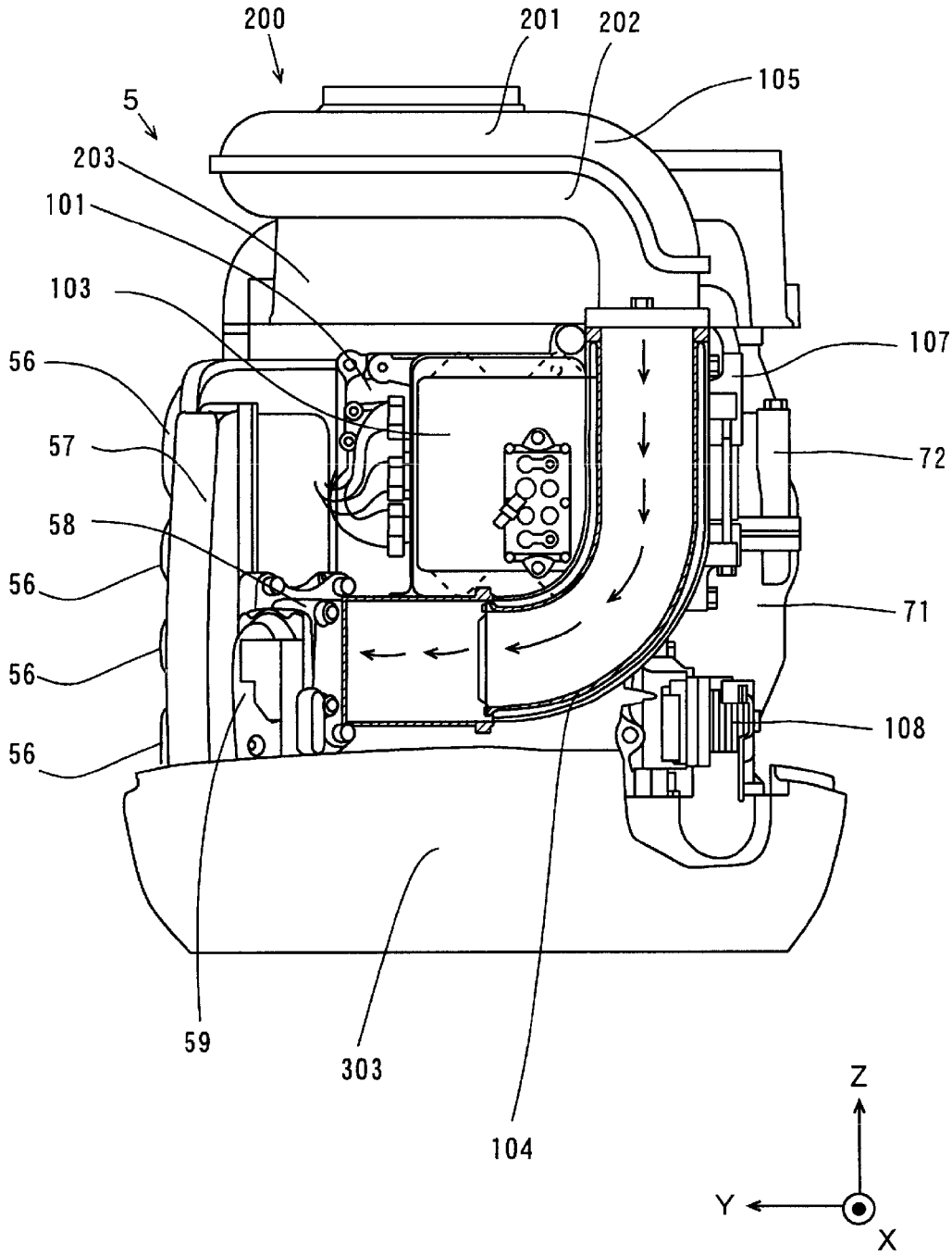
FIG. 7 is a front view of an engine.

FIG. 4 is a top view showing the construction of the engine 5. FIG. 5 is a partial cross-section of the upper casing 1 as seen from the −Y side. FIG. 6 is a partial cross-section of the upper casing 1 as seen from the +Y side. FIG. 7 is a front view of the engine 5.

As shown in FIG. 4 to FIG. 6, the engine body 51 includes a cylinder block 101 and a cylinder head 102. As shown in FIG. 5 to FIG. 7, the ECU (Engine Control Unit) 103 is disposed in front of the cylinder block 101.

As shown in FIG. 6 and FIG. 7, a first end of a communication pipe 104 generally in the shape of L is connected to the throttle body 58 in front of the cylinder block 101. A second end of the communication pipe 104 is connected to an intake duct 105 of a flywheel magneto cover 200. The flywheel magneto cover 200 and the intake duct 105 are described later in detail. In FIG. 7, a cross-section of the communication pipe 104 is shown.

As shown in FIG. 5, a starter motor 106 and a starter relay 107 are disposed in an upper portion of aside surface of the cylinder block 101 on the −Y side. An accelerator operation amount sensor 108 and a shift slider 109 are disposed below the starter relay 107. The shift slider 109 is connected to a shift lever (not shown) through a connection mechanism 110 formed with a shift rod and the like. A rectifier regulator unit 121 is disposed in a side surface of the cylinder head 102 on the −Y side.

As shown in FIG. 5 and FIG. 6, a fuel filter 122 (FIG. 5), a high-pressure filter 123 (FIG. 5), a vapor separator tank 124 (FIG. 6), and a canister 125 (FIG. 6) are disposed behind the cylinder head 102.

As shown in FIG. 4, a valve timing mechanism (not shown) and an oil control valve 126 to adjust an amount of oil supplied to the valve timing mechanism are disposed in the cylinder head 102. A thermostat 127, which controls the temperature of cooling water in the engine 5, is disposed in an upper surface of the cylinder head 102 on the −X side. An electrical component box 128, in which various electrical devices are housed, is disposed above the throttle drive motor 59.

(3) Construction of Engine

Now, a construction of the engine 5 is described in detail with reference to the drawings.

Figure 8:
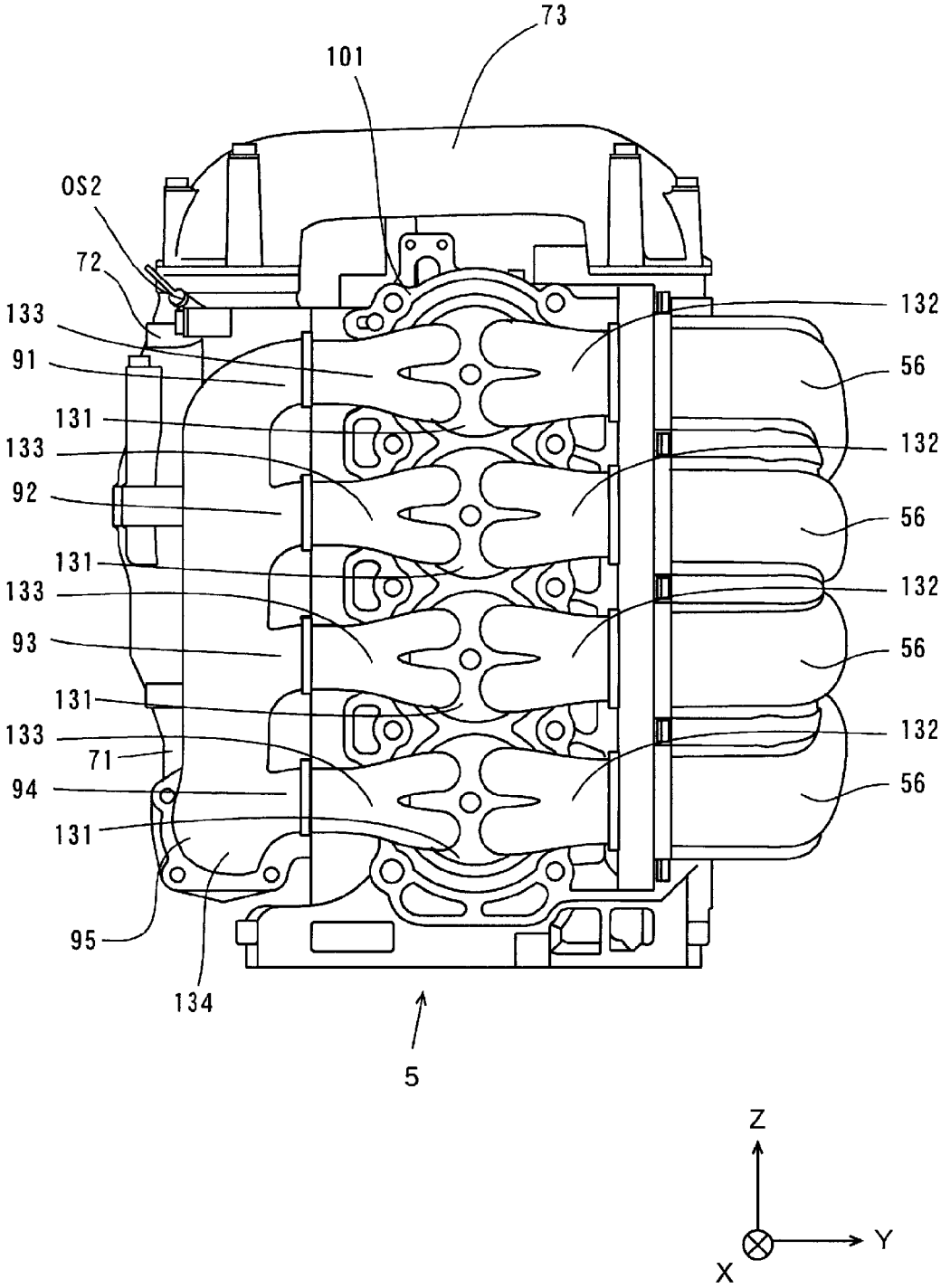
FIG. 8 is a rear view of a cylinder block.
Figure 9:
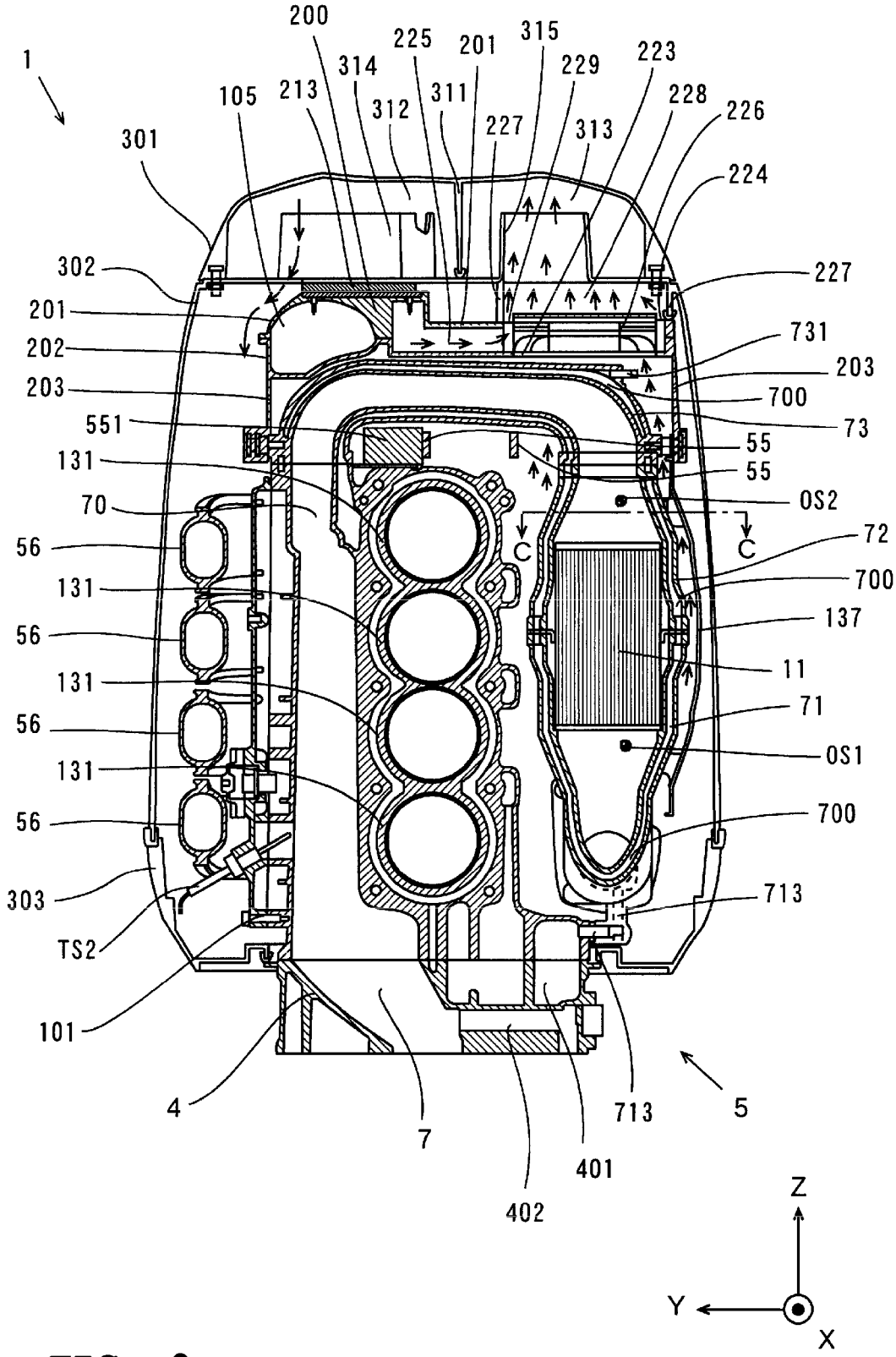
FIG. 9 is a sectional view taken along the line A-A of FIG. 4.
Figure 10:
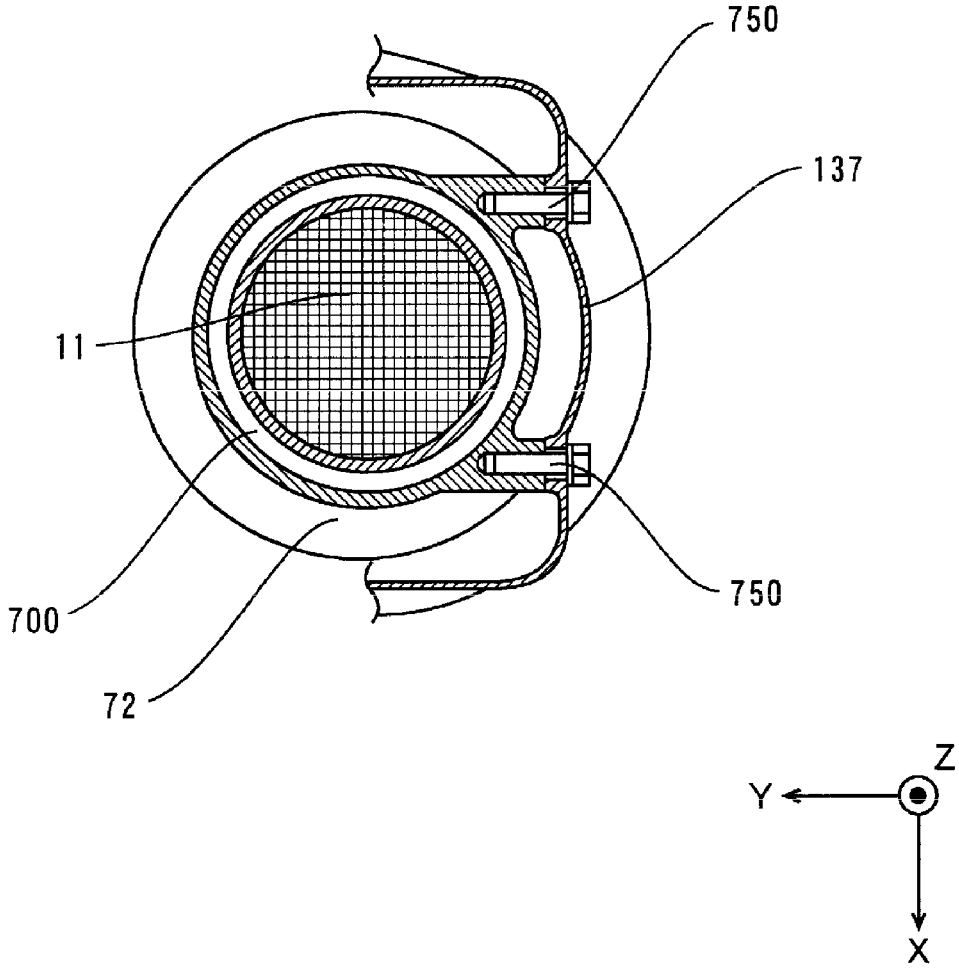
FIG. 10 is a sectional view taken along the line C-C of FIG. 9.
Figure 11:
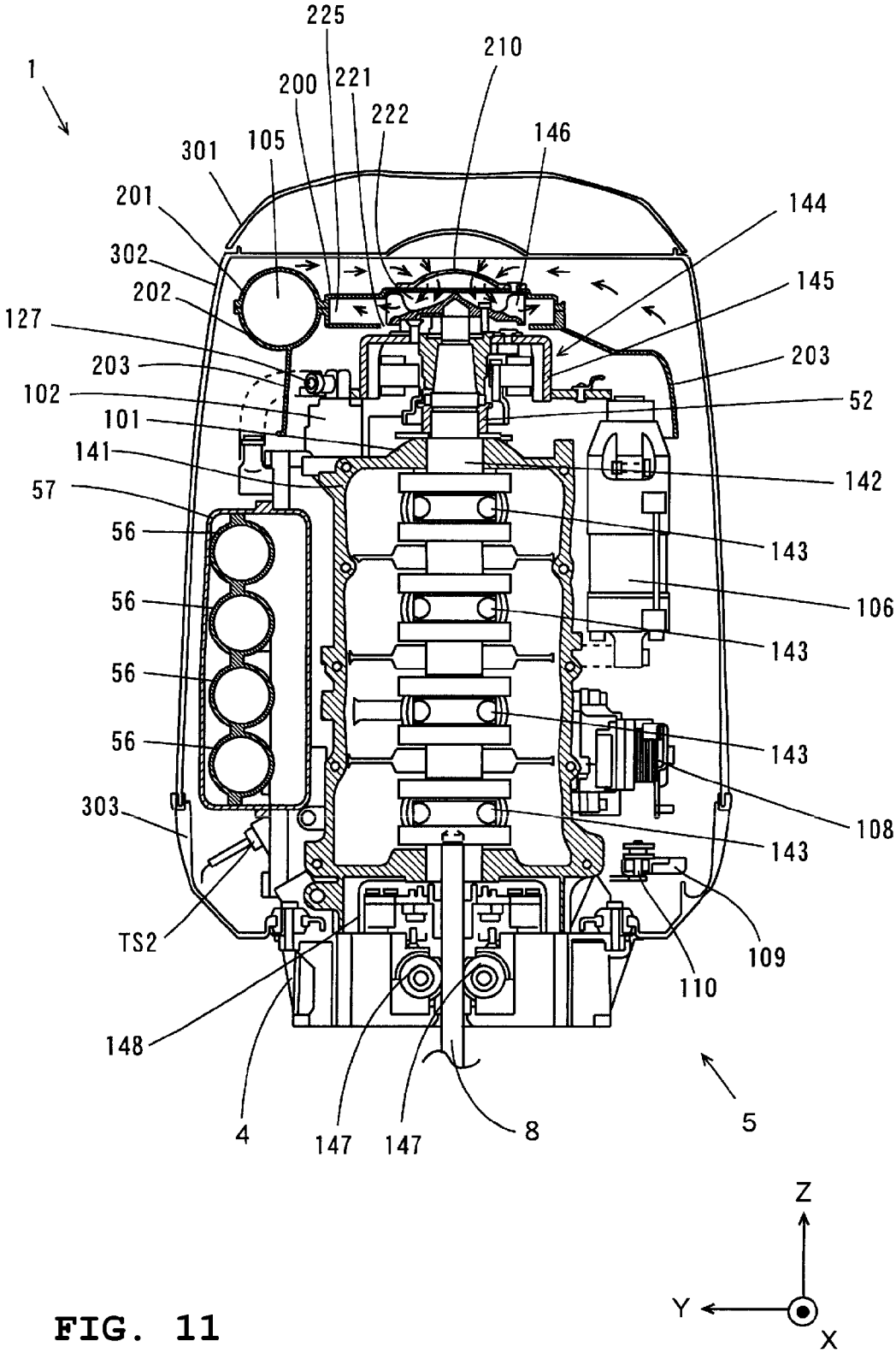
FIG. 11 is a sectional view taken along the line B-B of FIG. 4.

FIG. 8 is a rear view of the cylinder block 101. FIG. 9 is a cross-sectional view taken along the line A-A in FIG. 4. FIG. 10 is a cross-sectional view taken along the line C-C in FIG. 9. FIG. 11 is a cross-sectional view taken along the line B-B in FIG. 4.

As shown in FIG. 8 and FIG. 9, four cylinders 131 are disposed to be lined vertically in a rear portion of the cylinder block 101. As shown in FIG. 8, the intake port 132 and the exhaust port 133 are disposed in each cylinder 131. The intake port 132 and the exhaust port 133 are provided in the cylinder head 102 (refer to FIG. 4 to FIG. 6).

The intake pipe 56 is connected to each intake port 132. The flow-joining pipe 134 is connected to the four exhaust ports 133. As shown in FIG. 5 and FIG. 8, the flow-joining pipe 134 preferably has four branch portions 91 to 94 disposed to extend in the +Y direction and a flow-joining portion 95 disposed to extend in the +X direction.

The branch portions 91 to 94 are disposed to be lined in the vertical direction. The flow-joining portion 95 is disposed generally at the same height as the branch portion 94, which is the bottommost of the branch portions 91 to 94. The branch portions 91 to 94 are connected to the exhaust port 133, and the flow-joining portion 95 is connected to the first exhaust pipe 71.

As shown in FIG. 5 and FIG. 9, the catalyst 11 is disposed in a connection portion of the first exhaust pipe 71 and the second exhaust pipe 72. The catalyst 11 is fixed in the first and second exhaust pipes 71, 72. As the catalyst 11, a three-way catalyst is preferably used, for example.

As shown in FIG. 5, in the present preferred embodiment, the first exhaust pipe 71 is attached to the cylinder block 101 through an elastic member 135. Similarly, the second exhaust pipe 72 is attached to the cylinder block 101 through an elastic member 136. Accordingly, vibration transmitted from the cylinder block 101 to the catalyst 11 can be dampened. As a result, the reliability of the catalyst 11 can be improved. As the elastic members 135, 136, elastic rubber can be used, for example.

As shown in FIG. 9 and FIG. 10, a catalyst cover 137 is attached to cover a side surface of the first exhaust pipe 71 and that of the second exhaust pipe 72 on the −Y side. As shown in FIG. 10, the catalyst cover 137 is fixed to the second exhaust pipe 72 (and the third exhaust pipe 73) preferably by bolts 750, for example. The catalyst cover 137 is disposed to cover at least the −Y side of the catalyst from its center. Accordingly, when the engine 5 is under maintenance or the like, a user can be prevented from touching the first and second exhaust pipes 71, 72 that are heated by radiant heat of the catalyst 11. Other effects of the catalyst cover 137 are described later.

As shown in FIG. 5, FIG. 9 and FIG. 10, the flow-joining pipe 134, the first exhaust pipe 71, the second exhaust pipe 72, and the third exhaust pipe 73 has the flow path 700. The flow paths 700 of the flow-joining pipe 134, the first exhaust pipe 71, the second exhaust pipe 72, and the third exhaust pipe 73 are communicated with one another. When the engine 5 is operated, cooling water is supplied in the flow path 700. Accordingly, a temperature increase of the flow-joining pipe 134, the first exhaust pipe 71, the second exhaust pipe 72, and the third exhaust pipe 73 is prevented.

As shown in FIG. 5, a cooling water supply portion 711 is located in the lower end portion of the first exhaust pipe 71. An extension pipe 712 is disposed in the cooling water supply portion 711. In the present preferred embodiment, cooling water is supplied from a cooling water supply source (not shown) through the extension pipe 712 and the cooling water supply portion 711 to the flow path 700 of the first exhaust pipe 71.

When the engine 5 is not operated, cooling water in the flow path 700 is discharged through the cooling water supply portion 711 and the extension pipe 712. In the present preferred embodiment, the cooling water supply portion 711 is disposed in the lower end portion of the first exhaust pipe 71. Accordingly, cooling water in the flow path 700 can be discharged efficiently and securely. As a result, cooling water is sufficiently prevented from remaining in the flow path 700.

As shown in FIG. 9, the extension pipe 731 is disposed in the upper surface of the third exhaust pipe 73 so as to communicate between the flow path 700 and the outside of the third exhaust pipe 73. The extension pipe 731 is communicated to the outside of the upper casing 1 by a hose (not shown). Accordingly, air in the flow path 700 is discharged to the outside of the upper casing 1. As a result, cooling water can be efficiently circulated in the flow path 700.

As shown in FIG. 5 and FIG. 9, a first oxygen sensor OS1 is disposed in the first exhaust pipe 71. The first oxygen sensor OS1 is disposed on the upstream side of the catalyst 11. A second oxygen sensor OS2 and a first temperature sensor TS1 (FIG. 5) are disposed in the second exhaust pipe 72. The second oxygen sensor OS2 and the first temperature sensor TS1 are disposed on the downstream side of the catalyst 11.

As the first and second oxygen sensors OS1, OS2, a sensor using a ceramic component can be preferably used, for example. An oxygen sensor including zirconia ceramics can be preferably used, for example.

The first oxygen sensor OS1 detects an oxygen concentration in the first exhaust pipe 71. The second oxygen sensor OS2 detects an oxygen concentration in the second exhaust pipe 72. The first temperature sensor TS1 detects temperature in the second exhaust pipe 72. Detected values of the first oxygen sensor OS1, the second oxygen sensor OS2, and the first temperature sensor TS1 are supplied to the ECU 103 in FIG. 7.

The ECU 103 adjusts an air-fuel ratio of mixture in the cylinder 131 (FIG. 9) by controlling a fuel injection device (not shown) or a valve timing mechanism (not shown) based on a detected value of the first oxygen sensor OS1.

The ECU 103 determines whether or not exhaust gas is properly purified in the catalyst 11 based on a detected value of the second oxygen sensor OS2.

The ECU 103 drives a fan 226 (FIG. 9) based on a detected value of the first temperature sensor TS1.

The first oxygen sensor OS1 is preferably disposed above a bottom cowling 303 (FIG. 5). Accordingly, when water flows in the bottom cowling 303, water adhesion to the first oxygen sensor OS1 can be securely prevented. As a result, the reliability of the first oxygen sensor OS1 can surely be improved.

As shown in FIG. 9, the exhaust passage 70 is provided in a side portion of the cylinder block 101 on the +Y side. The exhaust passage 70 is arranged to extend vertically on the side of the cylinder 131. An upper end of the exhaust passage 70 is connected to the third exhaust pipe 73. A lower end of the exhaust passage 70 is connected to the exhaust passage 7 provided in the exhaust guide 4.

The second temperature sensor TS2 is disposed in a lower end portion of the exhaust passage 70. The second temperature sensor TS2 detects temperature in the exhaust passage 70. A detected value of the second temperature sensor TS2 is supplied to the ECU 103. The ECU 103 determines whether or not water is intruded into the exhaust passage 70 based on a detected value of the second temperature sensor TS2.

As shown in FIG. 5 and FIG. 9, a communication passage 713, which communicates between the first exhaust pipe 71 and spaces 401, 402 in the exhaust guide 4, is disposed in the lower end portion of the first exhaust pipe 71. In this case, when condensation occurs in the first exhaust pipe 71 when the engine 5 is not operating, water can be discharged from the communication passage 713 to the outside of the first exhaust pipe 71. Accordingly, water adhesion on the first oxygen sensor OS1 can be prevented. As a result, the reliability of the first oxygen sensor OS1 can be improved. The space 402 is used for an exhaust passage when the engine 5 idles.

As shown in FIG. 11, a crankcase 141 is disposed in front of the cylinder block 101. The crankshaft 142 is arranged to extend vertically in the crankcase 141. One end of a connecting rod 143, which is disposed in each cylinder 131 (FIG. 9), is connected to the crankshaft 142. The other end of connecting rod 143 is connected to a piston (not shown) disposed in each cylinder 131.

An upper end portion of the drive shaft 8 is connected to a lower end portion of the crankshaft 142. Accordingly, the torque of the crankshaft 142 is transmitted to the drive shaft 8.

As shown in FIG. 5 and FIG. 11, the flywheel magneto 144 is disposed above the crankcase 141. A rotor (flywheel) 145 of the flywheel magneto 144 is fixed to the crankshaft 142. The rotor 145 is rotated with the rotation of the crankshaft 142. Accordingly, electric power is generated in the flywheel magneto 144.

A fin 146 is attached to an upper end portion of the crankshaft 142. The fin 146 is rotated with the rotation of the crankshaft 142. Accordingly, heat in the upper casing 1 is discharged to the outside. A heat discharge pathway in the upper casing 1 is described later.

The flywheel magneto cover 200 is disposed above the crankcase 141 so as to cover the flywheel magneto 144 and the fin 146. The flywheel magneto cover 200 is described in detail in later paragraph.

As shown in FIG. 11, the cylinder block 101 is fixed on the exhaust guide 4. An upper mount 147 is disposed between the cylinder block 101 and the exhaust guide 4. Accordingly, the cylinder block 101 can be stabilized on the exhaust guide 4. An oil pump 148, which supplies oil to the engine 5, is disposed between the cylinder block 101 and the exhaust guide 4.

As shown in FIG. 5, FIG. 6, FIG. 9, and FIG. 11, the upper casing 1 has a top cover 301, a top cowling 302, and a bottom cowling 303. The bottom cowling 303 is fixed to the exhaust guide 4 so as to cover an outer periphery of a lower portion of the engine 5. The top cowling 302 is fixed to the bottom cowling 303 so as to cover the side and top of the engine 5. The top cover 301 is attached to an upper surface of the top cowling 302.

As shown in FIG. 9, a partition wall 311 is disposed in a center portion of the top cover 301 in the Y direction. The partition wall 311 defines a space 312 and a space 313 between the top cover 301 and the top cowling 302.

In the space 312, an inlet opening 314 is disposed in an upper surface of the top cowling 302. In the space 313, a ventilation opening 315 is disposed in an upper surface of the top cowling 302.

In the present preferred embodiment, air in the outside of the upper casing 1 is supplied through the space 312, the inlet opening 314, and the flywheel magneto cover 200 to the communication pipe 104 (FIG. 7). Air in the top cowling 302 is discharged through the flywheel magneto cover 200, ventilation opening 315, and the space 313 to the outside of the upper casing 1.

(4) Flywheel Magneto Cover (4-1) Construction of Flywheel Magneto Cover

Construction of the flywheel magneto cover 200 is described in detail with reference to the drawings.

Figure 12:
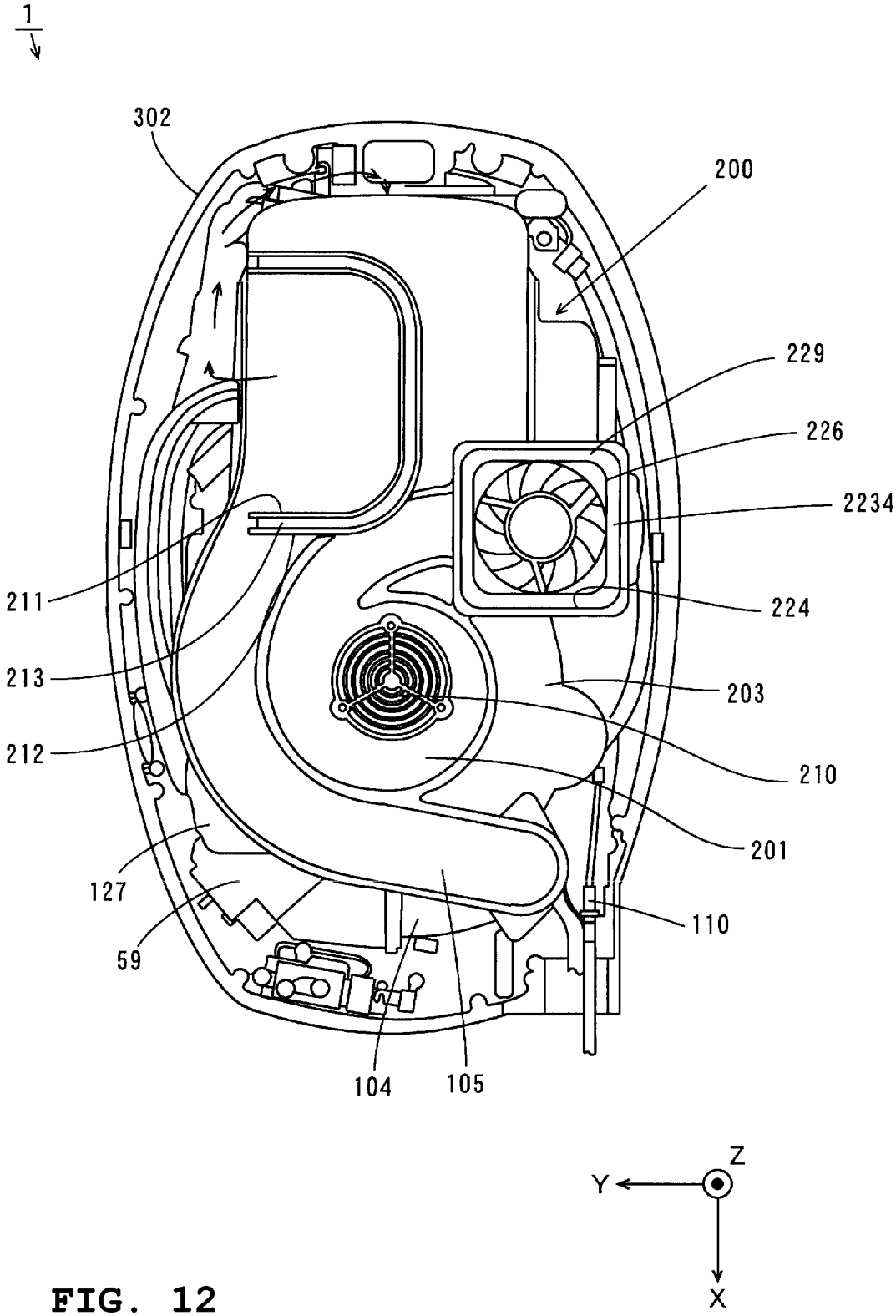
FIG. 12 is a top view of a flywheel magneto cover.
Figure 13:
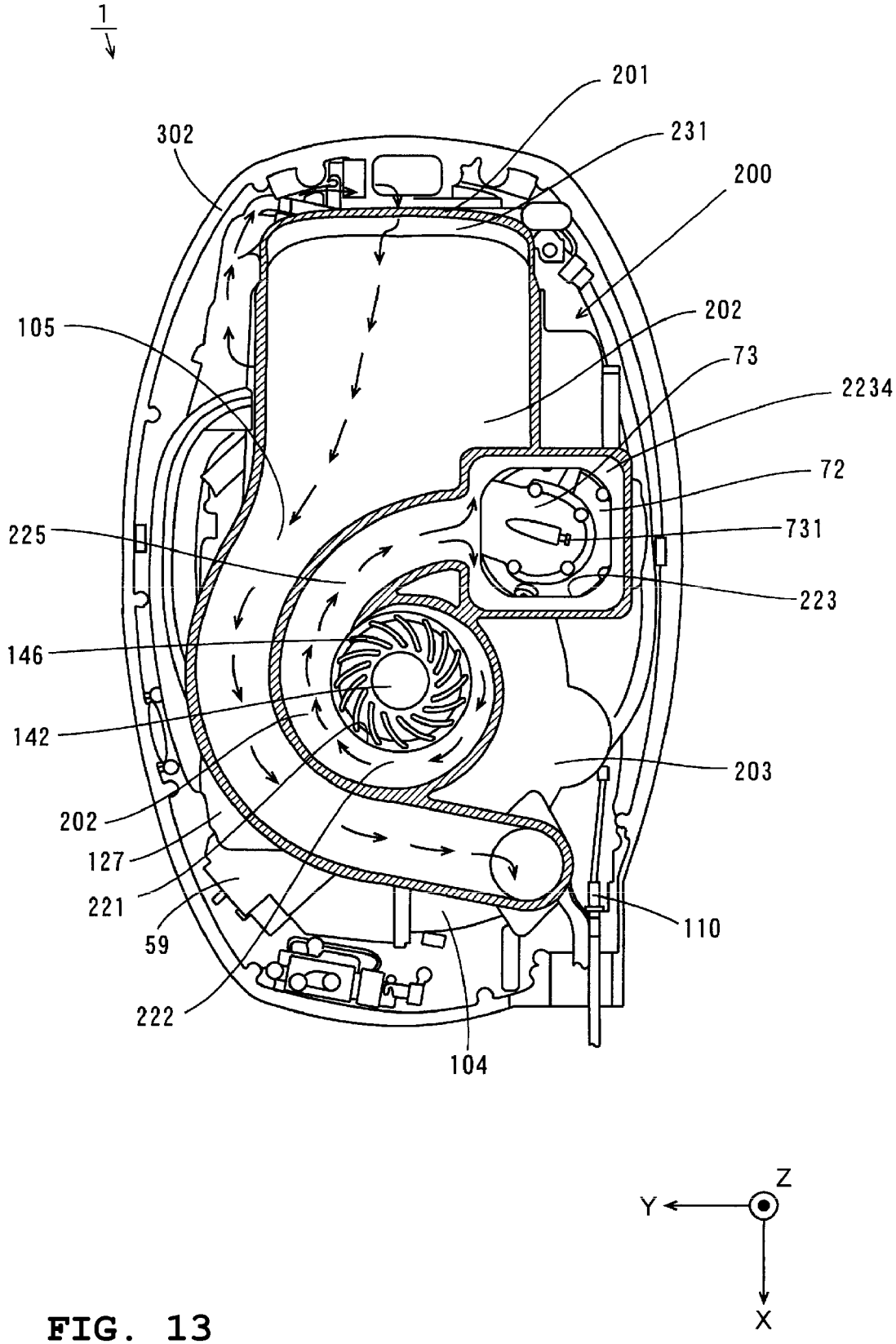
FIG. 13 is a partial cross-section showing an inner structure of a flywheel magneto cover.

FIG. 12 is a top view of the flywheel magneto cover 200. FIG. 13 is a partial cross-sectional view showing an inner structure of the flywheel magneto cover 200.

As shown in FIG. 5 to FIG. 7, FIG. 9, and FIG. 11 to FIG. 13, the flywheel magneto cover 200 has an upper cover 201 and a lower cover 202. In FIG. 13, a cross-section of the upper cover 201 is shown by hatch pattern.

As shown in FIG. 12, convex portions 211, 212, which are generally in the shape of U in an XY plane, are disposed on the −X side of the upper cover 201. The convex portions 211, 212 are arranged in a way that the both ends face the +Y side. An elastic member 213 is fitted between the convex portion 211 and the convex portion 212.

As shown in FIG. 9, the elastic member 213 is in tight contact with a ceiling surface of top cowling 302. In the present preferred embodiment, positions of the inlet opening 314 and the convex parts 211, 212 are set such that the inlet opening 314 is located inside the elastic member 213 in a XZ plane.

As shown in FIG. 7, FIG. 9, and FIG. 11 to FIG. 13, an outer wall 203 is arranged to extend in the −Z direction on a lower surface side of the lower cover 202. As shown in FIG. 9, a lower end portion of the outer wall 203 is fixed to the third exhaust pipe 73. Accordingly, the flywheel magneto cover 200 is fixed to the engine 5. The driven pulleys 53, 54 (FIG. 2 to FIG. 4), the third exhaust pipe 73, and the top and side of the flywheel magneto 144 (FIG. 11) are covered by the lower cover 202 and the outer wall 203.

As shown in FIG. 11 and FIG. 13, in the lower cover 202, an opening 221 is formed on an axial extension of the crankshaft 142. A space 222 generally in the shape of a cylinder is formed on the opening 221 of the flywheel magneto cover 200. The crankshaft 142 is inserted in the opening 221. In the space 222, the fin 146 is attached to the crankshaft 142. As shown in FIG. 11 and FIG. 12, on top of the fin 146 in the upper cover 201, a fin cover 210 in the shape of net having a plurality of openings is disposed.

As shown in FIG. 9 and FIG. 13, in the lower cover 202, an opening 223 is formed in an upper portion of the second exhaust pipe 72. In the upper cover 201, an opening 224 (FIG. 12), which has a larger area than the opening 223, is formed in an upper portion of the opening 223. As shown in FIG. 12 and FIG. 13, a space 2234 is formed between the opening 223 (FIG. 13) and the opening 224 (FIG. 12).

As shown in FIG. 9 and FIG. 13, a first ventilation duct 225 is formed to extend from the space 222 (FIG. 13) to the space 2234 (FIG. 13). As shown in FIG. 9, the electric fan 226 is disposed above the opening 223.

As shown in FIG. 9, a divider 227 is disposed between the top cowling 302 and the flywheel magneto cover 200 so as to form a space that connects the opening 224 and the ventilation opening 315 (this space is referred to as a second ventilation duct 228).

As shown in FIG. 9 and FIG. 12, dimensions of the opening 224 and the fan 226 are set so as to form a gap 229 between an inner peripheral surface of the opening 224 and an outer peripheral surface of the fan 226. The first ventilation duct 225 and the second ventilation duct 228 are communicated by the gap 229.

As shown in FIG. 9 and FIG. 13, the intake duct 105 is arranged to cover a portion of an outer periphery of the first ventilation duct 225. As shown in FIG. 7, an end portion of the intake duct 105 on the +X side is connected to the communication pipe 104.

As shown in FIG. 5 and FIG. 13, an inflow opening 231 is formed between an end portion of the upper cover 201 on the −X side and an end portion of the lower cover 202 on the −X side. The inflow opening 231 communicates the intake duct 105 with the outside of the flywheel magneto cover 200.

(4-2) Intake Passage

Hereinafter, an intake passage from the inlet opening 314 to the engine 5 is described.

As described above, in the present preferred embodiment, the elastic member 213 (FIG. 9) and the ceiling surface of the top cowling 302 (FIG. 9) are in tight contact. In this case, airflow from the inlet opening 314 (FIG. 9) to the ±X side and the −Y side is prevented by the elastic member 213. Thus, as indicated by the arrows in FIG. 9 and FIG. 12, air introduced into the intake opening 314 flows to a +Y side of the flywheel magneto cover 200.

As indicated by the arrows in FIG. 12, the air, which has flown to the +Y side of the flywheel magneto cover 200, flows to the −X side of the flywheel magneto cover 200. As indicated by the arrows in FIG. 5 and FIG. 13, the air flows from the inflow opening 231 into the intake duct 105. Thereafter, as indicated by the arrows in FIG. 7, the air is supplied from the intake duct 105 through the communication pipe 104 and the surge tank 57 to the intake pipe 56.

(4-3) Ventilation Passage

A ventilation passage in the top cowling 302 (FIG. 11) is described.

The fin 146 (FIG. 11) rotates when the engine 5 is operated. In this case, as indicated by the arrows in FIG. 11, air in the top cowling 302 is introduced from the fin cover 210 into the space 222 by the rotation of the fin 146.

As indicated by the arrows in FIG. 9 and FIG. 13, the air in the space 222 (FIG. 13) is discharged into the space 313 (FIG. 9) by the fin 146 through the first ventilation duct 225, the gap 229 (FIG. 9), the second ventilation duct 228 (FIG. 9), and the ventilation opening 315 (FIG. 9).

On the other hand, when the engine 5 stops, the fan 226 (FIG. 9) is driven by the control of the ECU 103 (FIG. 7) if the temperature in the second exhaust pipe 72 detected by the first temperature sensor TS1 (FIG. 5) increases to be a certain value or more. In this case, as indicated by the arrows in FIG. 9, air around the first exhaust pipe 71 and the second exhaust pipe 72 is discharged into the space 313 through the fan 226, the second ventilation duct 228, and the ventilation opening 315.

The air discharged into the space 313 is discharged to the outside of the top cover 301 from a discharge section provided in the space 313 or from a gap between the top cover 301 and the top cowling 302.

As described above, ventilation is performed in the top cowling 302. The ECU 103 stops the drive of the fan 226, if the temperature in the second exhaust pipe 72 (FIG. 5) detected by the first temperature sensor TS1 (FIG. 5) falls to be a certain value or less, or if the operation period of the fan 226 reaches a certain duration or more.

As described above, in the present preferred embodiment, the catalyst cover 137 is disposed to cover the first and second exhaust pipes 71, 72 (FIG. 9) on the −Y side. The catalyst cover 137 is disposed to extend to a lower end portion of the outer wall 203 of the flywheel magneto cover 200. In this case, the catalyst cover 137 is used as a guide wall to efficiently flow the air around the first and second exhaust pipes 71, 72 to the fan 226, when the top cowling 302 is ventilated. Accordingly, the air heated by the radiant heat of the catalyst 11 can be efficiently discharged to the outside of the top cowling 302.

(5) Effects of the Present Preferred Embodiment (5-1) Effects of the Engine 5

(a) Effects Caused By Positional Arrangement of the Catalyst 11 and the First and Second Oxygen Sensors OS1, OS2

As shown in FIG. 9, the first and second exhaust pipes 71, 72 are disposed on one side of the cylinder block 101, and the exhaust passage 70 is disposed on the other side of the cylinder block 101. The third exhaust pipe 73 is disposed to connect the second exhaust pipe 72 and the exhaust passage 70. In the construction described above, the catalyst 11 is disposed to be housed in the first exhaust pipe 71 and the second exhaust pipe 72. The first oxygen sensor OS1 is disposed in the first exhaust pipe 71, and the second oxygen sensor OS2 is disposed in the second exhaust pipe 72.

In the present preferred embodiment, the third exhaust pipe 73 is arranged to pass above the cylinder block 101. That is, the third exhaust pipe 73 is disposed sufficiently high in the upper casing 1.

In this case, in a case where water flows in reverse in the exhaust passage 7 (FIG. 1), the water can be securely prevented from passing through the third exhaust pipe 73 toward the upstream side. Accordingly, water adhesion to the catalyst 11, the first oxygen sensor OS1, and the second oxygen sensor OS2 can be sufficiently prevented. As a result, the catalyst 11, the first oxygen sensor OS1, and the second oxygen sensor OS2 can be improved in reliability.

(b) Effects of Flow-Joining Pipe 134

As shown in FIG. 8, exhaust gas discharged from each cylinder 131 is collected in the lower portion of the upper casing 1 by the flow-joining pipe 134. Accordingly, the first and second exhaust pipes 71, 72 can be disposed on the side of the cylinder block 101. As a result, the catalyst 11 can be disposed on the side of the cylinder block 101, thus upsizing of the outboard motor 100 can be prevented.

(c) Effects of Shapes of First Exhaust Pipe 71 and Second Exhaust Pipe 72

As shown in FIG. 9, a portion of the first exhaust pipe 71 and the second exhaust pipe 72 are disposed to extend vertically on the side of the cylinder 131. Accordingly, an increase in the width of the engine 5 can be prevented.

The first and second exhaust pipes 71, 72 and the exhaust passage 70 face each other while interposing the plurality of cylinders 131. In this case, the plurality of cylinders 131 can be disposed in the center of the upper casing 1. Accordingly, stability of the outboard motor 100 can be improved.

(d) Effect of Shape of Exhaust Passage 70

As shown in FIG. 9, the exhaust passage 70 is arranged to extend vertically on the side of the cylinder 131 in the cylinder block 101. Accordingly, an increase in the width of the cylinder block 101 can be prevented.

(e) Effects of Positional Arrangement of Third Exhaust Pipe 73

As shown in FIG. 9, the third exhaust pipe 73 is disposed to pass above the timing belt 55 and below the flywheel magneto cover 200. In this case, the drive pulley 52, the driven pulleys 53, 54, the timing belt 55, and the third exhaust pipe 73 shown in FIG. 2 and FIG. 3 do not have to be spaced out. Thus, upsizing of the engine 5 can be prevented.

As shown in FIG. 13, the third exhaust pipe 73 is disposed to be covered by the flywheel magneto cover 200. In this case, the third exhaust pipe 73 can be cooled by the air current generated by the fin 146 (FIG. 11) and the fan 226 (FIG. 9) of the flywheel magneto cover 200. Accordingly, excessive temperature increases in the catalyst 11 can be prevented.

(f) Effects of Positional Arrangement of Belt Tensioner 551

As shown in FIG. 9, the third exhaust pipe 73 is disposed to pass above the belt tensioner 551. In this case, the third exhaust pipe 73 and the exhaust passage 70 can be connected at the position where the expansion of the timing belt 55 in the width direction is sufficiently limited. Accordingly, the exhaust passage 70 can be formed in the proximity of the cylinder 131. As a result, downsizing of the cylinder block 101 in the width direction becomes possible.

(g) Effects of Positional Arrangement of First Exhaust Pipe 71

As shown in FIG. 5 and FIG. 8, the first exhaust pipe 71 is disposed in the way that a bottommost portion of an inner peripheral surface of the first exhaust pipe 71 is positioned lower than the bottommost cylinder 131. In this case, when water is produced in the first exhaust pipe 71 due to condensation or the like, downstream water flow caused by exhaust gas discharged from each cylinder 131 can be prevented. Accordingly, water adhesion to the catalyst 11 and the oxygen sensor OS1 can be securely prevented.

(5-2) Effects of Flywheel Magneto Cover 200

(a) Effects of Fan 226

As shown in FIG. 9, the electric fan 226 is disposed above the catalyst 11. In this case, heat generated in the catalyst 11 can be efficiently discharged to the outside of the upper casing 1. For example, even if ventilation is not performed by the fin 146 when the engine 5 stops operation, heat generated in the catalyst 11 can be efficiently discharged to the outside of the upper casing 1. Accordingly, a temperature increase in the top cowling 302 can be prevented. As a result, electric components (rectifier regulator unit 121, etc.) and fuel system components (vapor separator tank 124 etc.) can be prevented from causing defects by heat.

(b) Effects of Ventilation Passage

In the present preferred embodiment, when the engine 5 is operates, ventilation in the top cowling 302 is performed by the fin 146. When the engine 5 stops operation, ventilation in the top cowling 302 is performed by the fan 226.

As shown in FIG. 9, the second ventilation duct 228 and the ventilation opening 315 are used as a common ventilation passage regardless of ventilation performed by the fin 146 (FIG. 12) or the fan 226 (FIG. 13).

In this case, the number of passages used for ventilation can be reduced. Thus, the flywheel magneto cover 200 can be downsized.

(c) Effects of Elastic Member 213

As shown in FIG. 9, the elastic member 213 can prevent air introduced into the intake opening 314 from flowing in the ±X direction. Accordingly, air introduced into the intake opening 314 can be prevented from immediately flowing from the inflow opening 231 (FIG. 13) into the intake duct 105.

In this case, when water flows into the ventilation opening 315 together with air, the water can be prevented from flowing into the intake duct 105. Accordingly, reliability of the engine 5 can be improved.

(d) Effect of Shape of Inflow Opening 231

As shown in FIG. 5, the inflow opening 231 opens downward. Accordingly, water is securely prevented from flowing into the intake duct 105.

(6) Other Examples

In the above preferred embodiment, as shown in FIG. 9, the first oxygen sensor OS1 is preferably disposed in the first exhaust pipe 71. However, a positional arrangement of the first oxygen sensor OS1 is not limited to the above example. For example, the first oxygen sensor OS1 can be disposed in the flow-joining portion 95 (FIG. 8) of the flow-joining pipe 134.

The first oxygen sensor OS1 is preferably disposed upstream of the catalyst 11 and downstream of the branch portion 94 of the flow-joining pipe 134. In this case, an average value of air-fuel ratio of exhaust gas discharged from each cylinder 131 can be detected with high precision.

In the above preferred embodiment, the second oxygen sensor OS2 is preferably disposed in the second exhaust pipe 72. However, the second oxygen sensor OS2 may not be disposed necessarily. In this case, the ECU 103 may determine whether or not exhaust gas is properly purified in the catalyst 11 based on a detected value of the first temperature sensor TS1.

In the above-described preferred embodiment, the cooling water supply portion 711 and the extension pipe 712 are disposed in the lower end portion of the first exhaust pipe 71. However, the cooling water supply portion 711 and the extension pipe 712 may be disposed in the lower end portion of the flow-joining pipe 134.

In the above-described preferred embodiment, the communication passage 713 is disposed in the lower end portion of the first exhaust pipe 71. However, the communication passage 713 may be disposed in the lower end portion of the flow-joining portion 95.

The third exhaust pipe 73 does not have to pass above the topmost cylinder 131. It is acceptable as long as a portion of the third exhaust pipe 73 is located above the cylinder 131.

The number of the cylinders 131 does not have to be four, but may be less than or more than four, for example.

Two or more of the flow-joining pipe 134, the first exhaust pipe 71, the second exhaust pipe 72, the third exhaust pipe 73, and the exhaust passage 70 may be integrally formed.

In the above-described preferred embodiment, when the temperature in the second exhaust pipe 72 reaches a certain degree or more, the fan 226 is driven by the ECU 103. However, the condition for driving the fan 226 is not limited to the above example. For example, a temperature sensor may be disposed in the engine body 51, and the fan 226 may be driven by the ECU 103 when the temperature detected by the temperature sensor reaches a certain degree or more.

Second Preferred Embodiment

Figure 14:
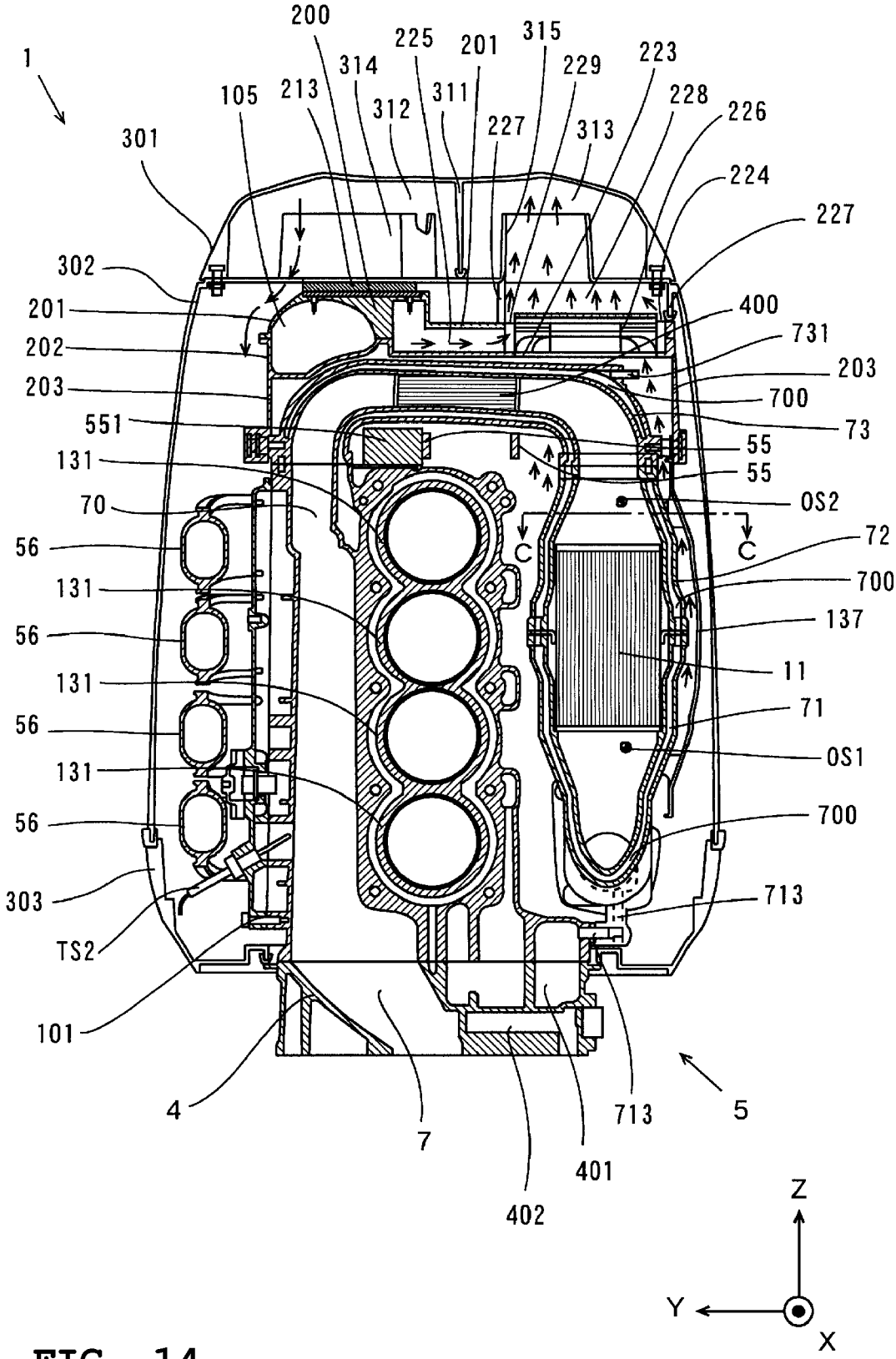
FIG. 14 shows the construction in an upper casing of an outboard motor according to the second preferred embodiment of the present invention.

FIG. 14 shows a construction of the upper casing 1 of the outboard motor according to the second preferred embodiment.

The outboard motor according to the present preferred embodiment differs from the outboard motor 100 according to the first preferred embodiment in the following points.

As shown in FIG. 14, in the present preferred embodiment, a moisture capture member 400 is preferably disposed in the third exhaust pipe 73. The moisture capture member 400 is preferably in the shape of a honeycomb, for example. The moisture capture member 400 is preferably made of metal or ceramic, for example.

In the present preferred embodiment, since the moisture capture member 400 is disposed in the third exhaust pipe 73, moisture in the third exhaust pipe 73 can be surely removed in the moisture capture member 400. Accordingly, droplets, which are created by water flown into the exhaust passage 70, can be securely prevented from flowing into the second exhaust pipe 72 and the first exhaust pipe 71 through the third exhaust pipe 73. As a result, the catalyst 11, the first oxygen sensor OS1, and the second oxygen sensor OS2 can be sufficiently improved in reliability.

Third Preferred Embodiment

Figure 15:
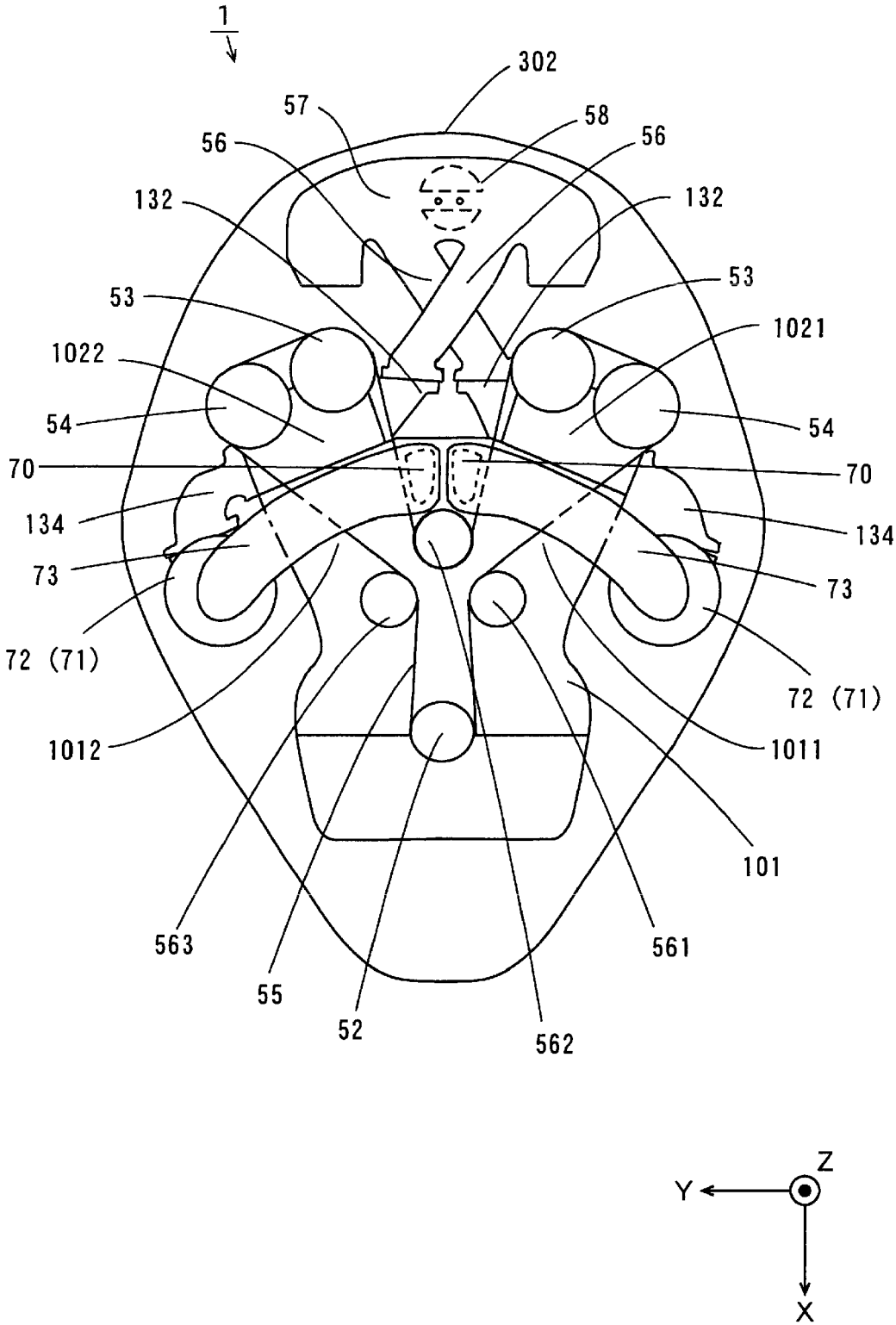
FIG. 15 is a schematic top view of an outboard motor according to the third preferred embodiment of the present invention.

FIG. 15 is a schematic top view of an outboard motor according to the third preferred embodiment.

The outboard motor according to the present preferred embodiment differs from the outboard motor 100 according to the first preferred embodiment in the following points.

As shown in FIG. 15, in the present preferred embodiment, a first branch portion 1011 and a second branch portion 1012 are preferably formed in the shape of V on the −X side of the cylinder block 101. In the first branch portion 1011, a plurality of cylinders (not shown) are disposed to be lined vertically. Similarly, in the second branch portion 1012, a plurality of cylinders (not shown) are disposed to be lined vertically.

A first cylinder head 1021 and a second cylinder head 1022 are disposed on the −X side of the first branch portion 1011 and that of the second branch portion 1012, respectively. In the same way as in FIG. 2, the driven pulleys 53, 54 are disposed in the first cylinder head 1021 and the second cylinder head 1022. In the same way as in FIG. 2, the driven pulley 52 is disposed on the +X side of the cylinder block 101. The timing belt 55 is wound around the drive pulley 52 and the driven pulleys 53, 54.

Idler pulleys 561, 562 and the belt tensioner 563 are disposed in a center portion of a top surface of the cylinder block 101. The outer peripheral surface of the timing belt 55 is abutted on the idler pulley 561 in a position between the drive pulley 52 and the driven pulley 54 on the first cylinder head 1021. The outer peripheral surface of the timing belt 55 is abutted on the idler pulley 562 in a position between the driven pulley 53 on the first cylinder head 1021 and the driven pulley 53 on the second cylinder head 1022. The outer peripheral surface of the timing belt 55 is abutted on the belt tensioner 563 in a position between the driven pulley 54 on the second cylinder head 1022 and the driven pulley 52.

The surge tank 57 is disposed on the −X side of the first and second cylinder heads 1021, 1022. The surge tank 57 is provided with the throttle body 58 and the plurality of intake pipes 56.

In the same way as in FIG. 8, the plurality of intake ports 132 are disposed on the +Y side of the first cylinder head 1021. In the same way as in FIG. 8, the plurality of intake ports 132 are disposed on the −Y side of the second cylinder head 1022. The intake pipes 56 are connected to the intake ports 132 respectively between the first cylinder head 1021 and the second cylinder head 1022.

The flow-joining pipe 134 similar to that of FIG. 8 is disposed on a side surface of the first cylinder head 1021 on the −Y side and on a side surface of the second cylinder head 1022 on the +Y side.

The flow-joining pipes 134 are connected with the first and second exhaust pipes 71, 72 respectively in the same way as in FIG. 9. In the same way as in FIG. 9, the catalyst 11 (not shown) is disposed in the first and second exhaust pipes 71, 72.

Two exhaust passages 70 are provided in the cylinder block 101 between the first cylinder head 1021 and the second cylinder head 1022 in the same way as in FIG. 9.

In the same way as in FIG. 9, the third exhaust pipe 73 is disposed to communicate each of the exhaust passages 70 with each of the second exhaust pipes 72. In the present preferred embodiment, the third exhaust pipe 73 on the first cylinder head 1021 side is provided to pass above the first branch portion 1011 and the timing belt 55, and the third exhaust pipe 73 on the second cylinder head 1022 side is disposed to pass above the second branch portion 1012 and the timing belt 55.

Fourth Preferred Embodiment

Figure 16:
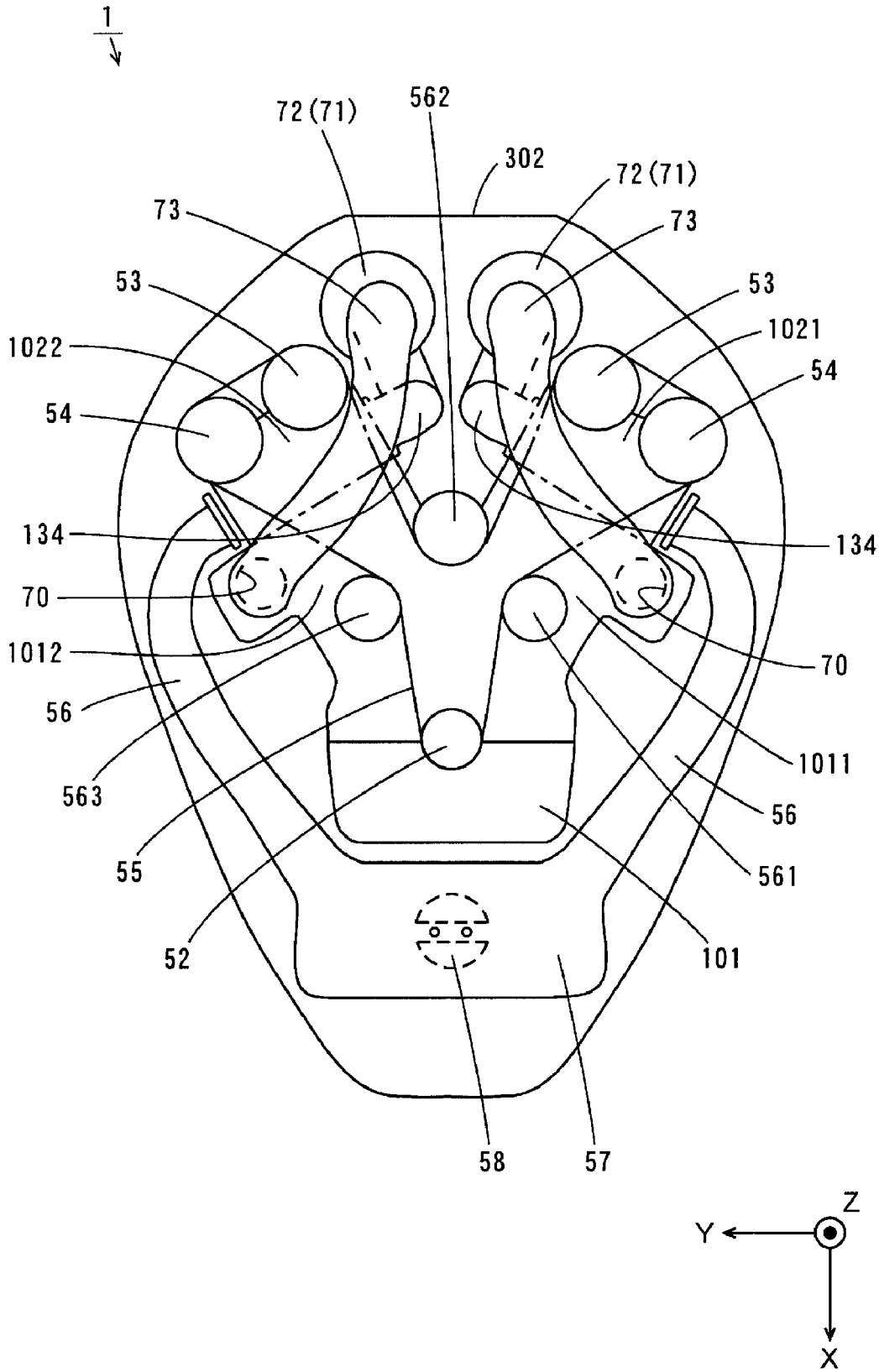
FIG. 16 is a schematic top view of an outboard motor according to the fourth preferred embodiment of the present invention.

FIG. 16 is a schematic top view of an outboard motor according to the fourth preferred embodiment.

The outboard motor according to the present preferred embodiment differs from the outboard motor according to the third preferred embodiment in the following points.

As shown in FIG. 16, in the present preferred embodiment, the surge tank 57 is disposed on the +X side of the cylinder block 101. The plurality of intake pipes 56 are disposed on the −Y side of the cylinder block 101 to connect the surge tank 57 and a side surface of the first cylinder head 1021 on the −Y side. The plurality of intake pipes 56 are disposed on the +Y side of the cylinder block 101 to connect the surge tank 57 and a side surface of the second cylinder head 1022 on the +Y side.

The flow-joining pipes 134 similar to the one in FIG. 8 are disposed on a side surface of the first cylinder head 1021 on the +Y side and on a side surface of the second cylinder head 1022 on the −Y side. On the −X side of the cylinder block 101, the first and second exhaust pipes 71, 72 are connected to each of the flow-joining pipes 134. The catalyst 11 (not shown) is disposed in the first and second exhaust pipes 71, 72.

The exhaust passages 70 similar to the one in FIG. 9 are provided in the first branch portion 1011 on the −Y side and in the second branch portion 1012 on the +Y side. The third exhaust pipe 73 is arranged to communicate each of the exhaust passages 70 with each of the second exhaust pipes 72. In the present preferred embodiment, the third exhaust pipe 73 on the first branch portion 1011 side is arranged to pass above the first branch portion 1011 and the timing belt 55, and the third exhaust pipe 73 on the second branch portion 1012 side is arranged to pass above the second branch portion 1012 and the timing belt 55.

Control System

According to the control system described below, problems pertaining to general outboard motors can be solved. First, problems pertaining to general outboard motors are described.

(1) Problems

In a case where opening of a throttle valve of an outboard motor engine is reduced quickly when a boat is traveling at high speed, a hull has a large braking force applied thereto and the boat speed is reduced suddenly. This causes, water in the vicinity of a rear portion of the hull to pass the hull (hereinafter, referred to as the following wave effect).

If a position of a gear (hereinafter, referred to as a shift gear), which switches between forward travel and backward travel, is switched from a forward traveling position to a backward traveling position in a state where the hull speed is reduced due to the above braking force, a propeller of the outboard motor rotates so as to push water from the rear to the front.

Under such a state, water, which is pushed to the front by the following wave effect and the propeller, may intrude into an exhaust passage from an outlet of exhaust gas. However, in a state where the engine is operated, due to exhaust pressure from the engine, water intruded from the outlet is prevented from reaching a top portion of the outboard motor.

On the other hand, when the hull is suddenly reduced in speed, water flows from the front to the rear with respect to the propeller since the hull travels forward through inertia. This water flow applies torque to the propeller. If the shift gear is set in a forward traveling position in such a state, engine speed is determined by the torque applied from the engine to the crankshaft and by the torque applied from water flow to the propeller.

In a case where the throttle valve is fully closed when the hull is traveling through inertia, the torque applied from water flow to the propeller becomes larger than the torque applied from the engine to the crankshaft. When the shift gear is changed to a backward position in such a state, the propeller is applied with the torque what is in an opposite direction of the torque applied from the engine to the crankshaft and that is larger than the torque applied from the engine to the crankshaft. Accordingly, the engine is caused to miss and stop.

In this case, the crankshaft rotates in reverse by the torque provided from the propeller, and exhaust gas in the exhaust passage flows backward. Accordingly, water intruded from the outlet into the exhaust passage may be sucked further.

(2) Control System

Figure 17:
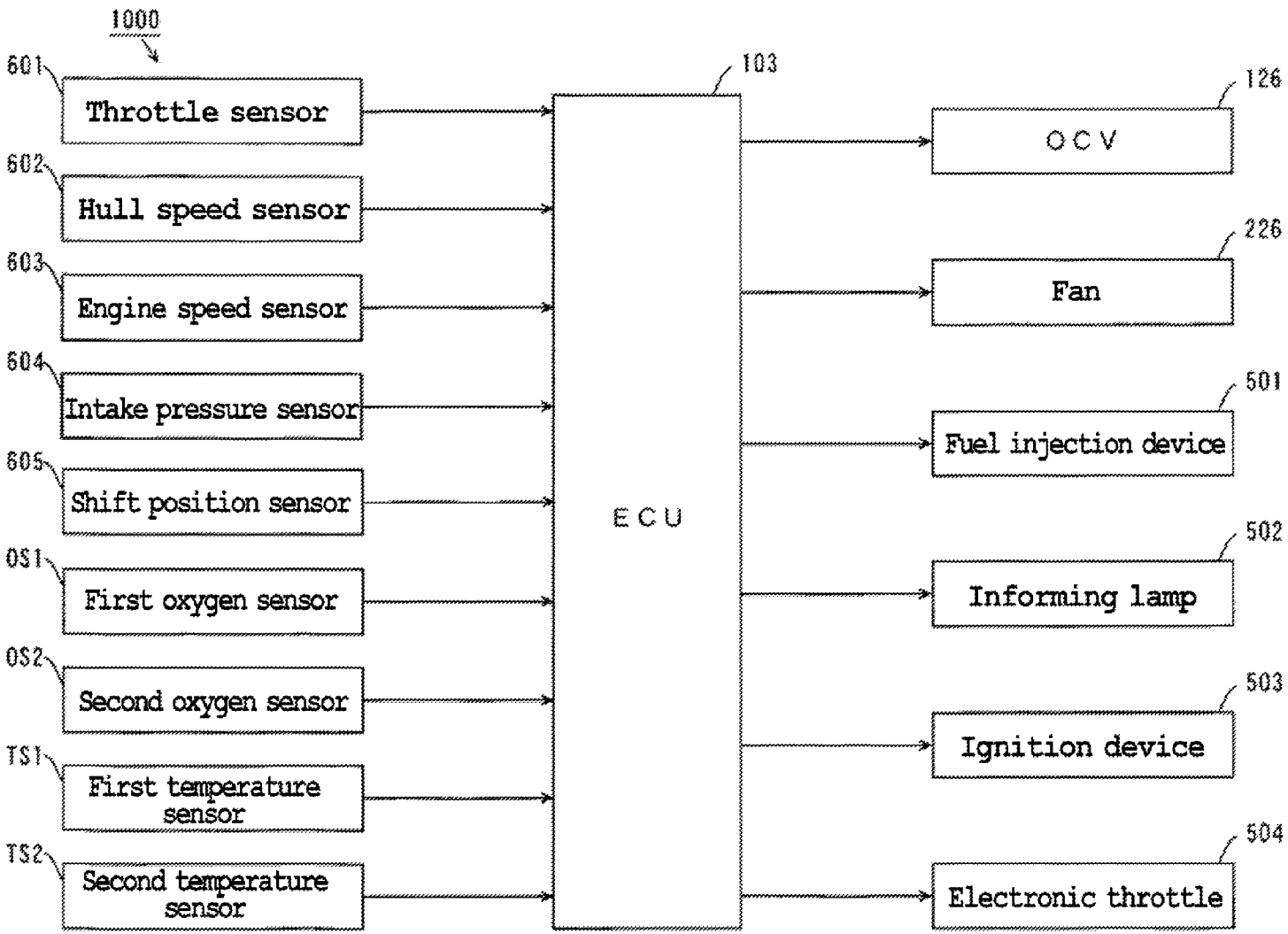
FIG. 17 is a block diagram showing an example of a control system of an outboard motor.

FIG. 17 is a block diagram showing an example of a control system of the outboard motor 100.

As shown in FIG. 17, a control system 1000 preferably includes the ECU 103, a throttle sensor 601, a hull speed sensor 602, an engine speed sensor 603, an intake pressure sensor 604, a shift position sensor 605, the first oxygen sensor OS1, the second oxygen sensor OS2, the first temperature sensor TS1, the second temperature sensor TS2, the oil control valve (OCV) 126, the fan 226, a fuel injection device 501, an informing lamp 502, an ignition device 503, and an electronic throttle 504.

The throttle sensor 601 is disposed in the throttle drive motor 59 (FIG. 4) and detects a throttle opening of the electronic throttle 504. The hull speed sensor 602 has a GPS function, for example, and detects the speed of the hull 901 (FIG. 1). The engine speed sensor 603 detects the rotational speed of the engine 5 (FIG. 1) by detecting a rotational angle of the crankshaft 142 (FIG. 11), for example. The intake pressure sensor 604 is disposed in the intake pipe 56 (FIG. 8) or the intake port 132 (FIG. 8), for example, and detects the pressure in the intake pipe 56 or the intake port 132. The shift position sensor 605 is disposed in a shift slider 109, for example, and detects a shift position (forward, neutral, or backward) of the shift gear.

The fuel injection device 501 is disposed in the intake port 132, for example, and injects fuel into the intake port 132. The informing lamp 502 is disposed in a position where it can be visually recognized by an operator of the hull 901 (FIG. 1), and is lit under a certain condition as described later. The ignition device 503 is disposed in the cylinder head 102 (FIG. 4) and performs spark-ignition of fuel-air mixture in the engine 5 (FIG. 1). The electronic throttle 504 is disposed in the intake port 132 (FIG. 8) and adjusts an amount of air introduced to the engine 5 by control of the ECU 103.

In the construction described above, if a change amount of a detected value of the second temperature sensor TS2 exceeds a certain threshold values per unit time (if temperature is decreased suddenly), the ECU 103 executes a water intrusion suppression control described below.

In the water intrusion suppression control, when the throttle opening is a certain threshold value or lower, when the speed of the hull 901 is a certain threshold value or higher, and when a shift position is in a forward position, the ECU 103 sets the shortest overlap period of an intake valve (not shown) and an exhaust valve (not shown) by increasing the throttle opening of the electronic throttle 504 to a certain target value and by adjusting an oil amount of the OCV 126.

Accordingly, torque generated in the engine 5 can be increased. At the same time, an amount of burned gas (EGR gas) that flows backward into the engine 5 can be reduced by shortening the overlap period. As a result, when any of the problems as described above occurs to the outboard motor 100, engine misfire can be prevented. Accordingly, backflow of water to an upper portion of the outboard motor 100 can be prevented.

The certain target value of throttle opening described above is set larger than the certain threshold value of throttle opening described above. The certain target value of throttle opening is a variable set in accordance with a load of the engine 5 that is calculated based on the hull speed and a detected value of the intake pressure sensor 604.

In addition to the control described above, the ECU 103 may control the ignition device 503 to advance an ignition timing of fuel-air mixture in the engine 5 to the proximity of engine knock.

The certain target value of throttle opening may be calculated by the ECU 103 in accordance with hull speed, so that the engine speed can be reduced as much as possible while misfire is avoided.

In the present preferred embodiment, the ECU 103 preferably sets the appropriate target value of throttle opening in accordance with the hull speed, and adjusts an injection amount of fuel injected by the fuel injection device 501 to adjust an air-fuel ratio to an appropriate value.

The ECU 103 determines whether or not exhaust gas is properly purified in the catalyst 11 (FIG. 9), based on a detected value of the second oxygen sensor OS2 and a detected value of the first temperature sensor TS1. When the exhaust gas is determined not to be purified properly in the catalyst 11, the ECU 103 lights the informing lamp 502. Accordingly, the operator can recognize a state of the catalyst 11.

The ECU 103 controls the fan 226 based on a detected value of the engine speed sensor 603. In detail, the ECU 103 actuates the fan 226 when the engine 5 stops. Accordingly, a temperature increase in the top cowling 302 (FIG. 9) can be prevented even when the engine 5 is not driven.

The ECU 103 may control the fan 226 based on a detected value of the first temperature sensor TS1. Accordingly, a temperature increase in the top cowling 302 (FIG. 9) can be securely prevented.

The present invention can be effectively utilized in an outboard motor mounted in a boat.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an upper casing;

a four-stroke engine including a plurality of cylinders aligned vertically disposed in the upper casing;

a lower casing disposed below the upper casing;

a discharge section disposed in a lower portion of the lower casing and arranged to discharge burned gas generated in the plurality of cylinders;

an exhaust passage arranged to extend from an inside of the upper casing to a lower portion of the lower casing and to guide the burned gas from the plurality of cylinders to the discharge section;

a catalyst arranged to purify the burned gas in the exhaust passage, the catalyst being arranged in the upper casing; and a moisture capture member disposed downstream of the catalyst in the exhaust passage, the moisture capture member being arranged in the upper casing; wherein the moisture capture member is arranged to prevent moisture from flowing upstream of the moisture capture member; and a lowermost end of the upper casing is located at a position that substantially corresponds to a position of a lowermost portion of the four-stroke engine.

2. The outboard motor according to claim 1, wherein the moisture capture member is arranged to prevent diffused droplets of water from flowing upstream of the moisture capture member.

3. The outboard motor according to claim 1, further comprising an oxygen sensor located between the catalyst and the moisture capture member in the exhaust passage.

4. The outboard motor according to claim 1, wherein the moisture capture member has a honeycomb configuration.

5. The outboard motor according to claim 4, wherein the moisture capture member is made of metal.

6. The outboard motor according to claim 1, wherein the exhaust passage includes a flow-joint pipe attached to the four-stroke engine so as to be substantially aligned with the plurality of cylinders and a first pipe extending from the flow-joint pipe; and both of the flow-joint pipe and the first pipe are arranged in the upper casing.

7. An outboard motor comprising:

an upper casing;

a four-stroke engine including a plurality of cylinders aligned vertically disposed in the upper casing;

a lower casing disposed below the upper casing;

a discharge section disposed in a lower portion of the lower casing and arranged to discharge burned gas generated in the plurality of cylinders;

an exhaust passage arranged to extend from an inside of the upper casing to a lower portion of the lower casing and to guide the burned gas from the plurality of cylinders to the discharge section;

a catalyst arranged to purify the burned gas in the exhaust passage, the catalyst being arranged in the upper casing; and a moisture capture member disposed downstream of the catalyst in the exhaust passage, the moisture capture member being arranged in the upper casing; wherein the moisture capture member is arranged to prevent moisture from flowing upstream of the moisture capture member;

the moisture capture member has a honeycomb configuration; and the moisture capture member is made of ceramic.

8. The outboard motor according to claim 1, wherein the moisture capture member is defined by a structural member disposed inside the exhaust passage to prevent moisture from flowing upstream of the structural member.

9. An outboard motor comprising:

an upper casing;

a four-stroke engine including a plurality of cylinders aligned vertically disposed in the upper casing;

a lower casing disposed below the upper casing;

a discharge section disposed in a lower portion of the lower casing and arranged to discharge burned gas generated in the plurality of cylinders;

an exhaust passage arranged to extend from inside of the upper casing to a lower portion of the lower casing and guide burned gas from the plurality of cylinders to the discharge section;

a moisture capture member disposed in the exhaust passage downstream of the plurality of cylinders; and an oxygen sensor located upstream of the moisture capture member in the exhaust passage; wherein the moisture capture member is arranged to prevent moisture from flowing upstream of the moisture capture member;

a lowermost end of the upper casing is located at a position that substantially corresponds to a position of a lowermost portion of the four-stroke engine; and both of the oxygen sensor and the moisture capture member are arranged in the upper casing.

10. The outboard motor according to claim 9, wherein the moisture capture member has a honeycomb shape.

11. The outboard motor according to claim 10, wherein the moisture capture member is made of metal.

12. An outboard motor comprising:

an upper casing;

a four-stroke engine including a plurality of cylinders aligned vertically disposed in the upper casing;

a lower casing disposed below the upper casing;

a discharge section disposed in a lower portion of the lower casing and arranged to discharge burned gas generated in the plurality of cylinders;

an exhaust passage arranged to extend from inside of the upper casing to a lower portion of the lower casing and guide burned gas from the plurality of cylinders to the discharge section;

a moisture capture member disposed in the exhaust passage downstream of the plurality of cylinders; and an oxygen sensor located upstream of the moisture capture member in the exhaust passage; wherein the moisture capture member is arranged to prevent moisture from flowing upstream of the moisture capture member;

the moisture capture member has a honeycomb shape; and the moisture capture member is made of ceramic.

13. An outboard motor comprising:

an upper casing;

a four-stroke engine including a plurality of cylinders aligned vertically disposed in the upper casing;

a lower casing disposed below the upper casing;

a discharge section disposed in a lower portion of the lower casing and arranged to discharge burned gas generated in the plurality of cylinders;

an exhaust passage arranged to extend from an inside of the upper casing to a lower portion of the lower casing and to guide the burned gas from the plurality of cylinders to the discharge section;

a catalyst arranged to purify the burned gas in the exhaust passage, the catalyst being arranged in the upper casing; and a moisture capture member disposed downstream of the catalyst in the exhaust passage and arranged in the upper casing; wherein the moisture capture member is arranged to prevent moisture from flowing upstream of the moisture capture member; and an uppermost end of the lower casing is located at a position that substantially corresponds to a position of a lowermost portion of the four-stroke engine.

* * * * *